US010714810B2

(12) United States Patent
Hong et al.

(10) Patent No.: US 10,714,810 B2
(45) Date of Patent: Jul. 14, 2020

(54) ANTENNA APPARATUS FOR USE IN WIRELESS DEVICES

(71) Applicant: Samsung Electronics Co., Ltd., Suwon-si, Gyeonggi-do (KR)

(72) Inventors: Won-Bin Hong, Seoul (KR); Kwang-Hyun Baek, Anseong-si (KR); Seung-Tae Ko, Bucheon-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

(21) Appl. No.: 14/919,168

(22) Filed: Oct. 21, 2015

(65) Prior Publication Data

US 2016/0118713 A1 Apr. 28, 2016

(30) Foreign Application Priority Data

Oct. 22, 2014 (KR) ..... 10-2014-0143389

(51) Int. Cl.

| | |
|---|---|
| ***H01Q 1/24*** | (2006.01) |
| ***H01Q 25/00*** | (2006.01) |
| ***H01Q 5/385*** | (2015.01) |
| ***H01Q 9/04*** | (2006.01) |
| ***H01Q 1/38*** | (2006.01) |

(Continued)

(52) U.S. Cl.

CPC ..... *H01Q 1/243* (2013.01); *H01Q 1/38* (2013.01); *H01Q 5/385* (2015.01); *H01Q 9/0407* (2013.01); *H01Q 11/10* (2013.01); *H01Q 19/005* (2013.01); *H01Q 25/001* (2013.01)

(58) Field of Classification Search

CPC ..... H01Q 1/243; H01Q 1/2283; H01Q 1/40; H01Q 1/405; H01Q 5/378; H01Q 5/385; H01Q 5/392

See application file for complete search history.

(56) References Cited

U.S. PATENT DOCUMENTS

| | | | |
|---|---|---|---|
| 7,015,860 | B2 | 3/2006 | Alsliety |
| 8,022,887 | B1 | 9/2011 | Zarnaghi |

(Continued)

FOREIGN PATENT DOCUMENTS

| | | | |
|---|---|---|---|
| JP | 2001-85920 | A | 3/2001 |
| JP | 2004-056498 | A | 2/2004 |

(Continued)

OTHER PUBLICATIONS

European Search Report dated Mar. 18, 2019; European Appln. No. 15 852 719.2-1205.

(Continued)

*Primary Examiner* — Robert Karacsony

(74) *Attorney, Agent, or Firm* — Jefferson IP Law, LLP

(57) ABSTRACT

The present disclosure relates to a pre-5th-Generation (5G) or 5G communication system to be provided for supporting higher data rates Beyond 4th-Generation (4G) communication system such as Long Term Evolution (LTE). An antenna for decreasing a signal loss caused by a dielectric loss in an antenna by decreasing a space of the antenna in a wireless device and improving performance of the antenna is provided. The antenna includes a first radiator, and a second radiator installed on a cover of the wireless device to radiate a radio signal radiated by the first radiator, the second radiator separate from and facing the first radiator.

14 Claims, 31 Drawing Sheets

| Beam | ANTENNA IN USE |
|---|---|
| Beam ID 1 | VP : A~D (4EA)<br>HP : 1~4 (4EA) |
| Beam ID 2 | VP : A~D (4EA)<br>HP : 1~4 (4EA) |
| Beam ID 3 | VP : A~H (8EA)<br>HP : 1~8 (8EA) |

(51) Int. Cl.
*H01Q 11/10* (2006.01)
*H01Q 19/00* (2006.01)

(56) References Cited

U.S. PATENT DOCUMENTS

| | | | | |
|---|---|---|---|---|
| 8,270,914 | B2 | 9/2012 | Pascolini et al. | |
| 2001/0021643 | A1 | 9/2001 | Itoh | |
| 2002/0140611 | A1 | 10/2002 | Ligander et al. | |
| 2008/0036608 | A1 | 2/2008 | Sakama | |
| 2009/0009403 | A1 | 1/2009 | Sullivan | |
| 2009/0020328 | A1 | 1/2009 | Sullivan et al. | |
| 2011/0241949 | A1 | 10/2011 | Nickel et al. | |
| 2011/0248895 | A1 | 10/2011 | Bungo et al. | |
| 2012/0223866 | A1 | 9/2012 | Ayala Vasquez et al. | |
| 2013/0070952 | A1 | 3/2013 | Mai et al. | |
| 2013/0076571 | A1 | 3/2013 | Desclos et al. | |
| 2013/0109435 | A1 | 5/2013 | McCaughey et al. | |
| 2014/0002313 | A1 | 1/2014 | Yang et al. | |
| 2014/0009355 | A1* | 1/2014 | Samardzija ..... | H01Q 1/42 343/789 |
| 2014/0071007 | A1 | 3/2014 | Liu | |
| 2014/0091974 | A1 | 4/2014 | Desclos et al. | |
| 2014/0152517 | A1 | 6/2014 | Su et al. | |
| 2014/0285385 | A1* | 9/2014 | Aoki ..... | H01Q 1/243 343/702 |
| 2014/0292584 | A1 | 10/2014 | Lin | |

FOREIGN PATENT DOCUMENTS

| | | | |
|---|---|---|---|
| JP | 2012-182791 | A | 9/2012 |
| JP | 2014-187452 | A | 10/2014 |

OTHER PUBLICATIONS

Japanese Notice of Preliminary Rejection dated Jul. 3, 2019; Application # JP2017-522337.

European Search Report dated Nov. 22, 2019; European Appln. No. 15 852 719.2-1205.

* cited by examiner

| | |
|---|---|
| FIRST PARASITIC PATCH (120A) | |
| SECOND PARASITIC PATCH (120B) | |
| FIRST ANTENNA PATTERN (110A) | |
| SECOND ANTENNA PATTERN (110B) | |

| Beam | ANTENNA IN USE |
|---|---|
| Beam ID 1 | VP : A~D (4EA)<br>HP : 1~4 (4EA) |
| Beam ID 2 | VP : A~D (4EA)<br>HP : 1~4 (4EA) |
| Beam ID 3 | VP : A~H (8EA)<br>HP : 1~8 (8EA) |

ANTENNA APPARATUS FOR USE IN WIRELESS DEVICES

CROSS-REFERENCE TO RELATED APPLICATION(S)

This application claims the benefit under 35 U.S.C. § 119(a) of a Korean patent application filed on Oct. 22, 2014 in the Korean Intellectual Property Office and assigned Serial number 10-2014-0143389, the entire disclosure of which is hereby incorporated by reference.

TECHNICAL FIELD

The present disclosure relates to an antenna of a wireless device.

BACKGROUND

To meet the demand for wireless data traffic having increased since deployment of 4G communication systems, efforts have been made to develop an improved 5G or pre-5G communication system. Therefore, the 5G or pre-5G communication system is also called a 'Beyond 4G Network' or a 'Post LTE System'.

The 5G communication system is considered to be implemented in higher frequency (mmWave) bands, e.g., 60 GHz bands, so as to accomplish higher data rates. To decrease propagation loss of the radio waves and increase the transmission distance, the beamforming, massive multiple-input multiple-output (MIMO), Full Dimensional MIMO (FD-MIMO), array antenna, an analog beam forming, large scale antenna techniques are discussed in 5G communication systems.

In addition, in 5G communication systems, development for system network improvement is under way based on advanced small cells, cloud Radio Access Networks (RANs), ultra-dense networks, device-to-device (D2D) communication, wireless backhaul, moving network, cooperative communication, Coordinated Multi-Points (COMP), reception-end interference cancellation and the like.

In the 5G system, Hybrid FSK and QAM Modulation (FQAM) and sliding window superposition coding (SWSC) as an advanced coding modulation (ACM), and filter bank multi carrier (FBMC), non-orthogonal multiple access (NOMA), and sparse code multiple access (SCMA) as an advanced access technology have been developed.

With the advancement of communication technologies in recent years, wireless devices have been gradually becoming smaller in size and lighter in weight. To cope with such a trend, a built-in antenna is implemented within a wireless device.

Meanwhile, an antenna of a wireless device supports various services (e.g., $4^{th}$ generation (4G) long term evolution (LTE), global positioning system (GPS), wireless fidelity (Wi-Fi, etc.). For this reason, there is research for decreasing a volume of an antenna to decrease size and weight. Further, there is research for improving antenna performance of the wireless device.

The above information is presented as background information only to assist with an understanding of the present disclosure. No determination has been made, and no assertion is made, as to whether any of the above might be applicable as prior art with regard to the present disclosure.

SUMMARY

Aspects of the present disclosure are to address at least the above-mentioned problems and/or disadvantages and to provide at least the advantages described below. Accordingly, an aspect of the present disclosure is to provide an antenna for decreasing a space consumed in a wireless device.

Another aspect of the present disclosure is to provide an antenna for improving performance in a wireless device.

In accordance with an aspect of the present disclosure, an antenna of a wireless device is provided. The antenna includes a first radiator, and a second radiator installed on a cover of the wireless device to radiate a radio signal radiated by the first radiator, wherein the second radiator is separated from and facing the first radiator.

In accordance with another aspect of the present disclosure, a wireless device is provided. The wireless device includes a main body having a first radiator, and a cover having a second radiator to radiate a radio signal radiated by the first radiator, wherein the second radiator faces and is separated from the first radiator.

Other aspects, advantages, and salient features of the disclosure will become apparent to those skilled in the art from the following detailed description, which, taken in conjunction with the annexed drawings, discloses various embodiments of the present disclosure.

BRIEF DESCRIPTION OF THE DRAWINGS

The above and other aspects, features, and advantages of certain embodiments of the present disclosure will be more apparent from the following description taken in conjunction with the accompanying drawings, in which.

Throughout the drawings, like reference numerals will be understood to refer to like parts, components, and structures.

DETAILED DESCRIPTION

The following description with reference to the accompanying drawings is provided to assist in a comprehensive understanding of various embodiments of the present disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the present disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the present disclosure. Accordingly, it should be apparent to those skilled in the art that the following description of various embodiments of the present disclosure is provided for illustration purpose only and not for the purpose of limiting the present disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

Various embodiments of the present disclosure relate to an antenna for decreasing signal loss due to dielectric loss in an antenna by decreasing the space consumed by the antenna in a wireless device and improving performance of the antenna.

The wireless device may be a portable electronic device such as a smart phone having a wireless access function. The wireless device may a portable terminal, a mobile phone, a mobile pad, a tablet computer, a handheld computer, and a personal digital assistant (PDA). The wireless device may a wireless access-enabled media player, a camera, a speaker, and a television. The wireless device may be a wearable electronic device such as a smart watch, a virtual reality device such as a wearable head mounted display, and an augmented reality device such as smart glasses. The wireless device may be a point of sales (POS) device or a beacon device. The wireless device may be a device implemented by combining two or more functions of the aforementioned devices.

Figure 1:
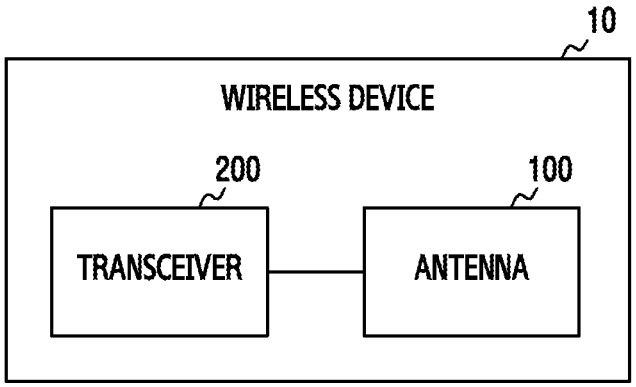
FIG. 1 is a block diagram of a wireless device according to various embodiments of the present disclosure.

FIG. 1 is a block diagram of a wireless device according to various embodiments of the present disclosure.

Referring to FIG. 1, a wireless device 10 includes an antenna 100 and a transceiver 200. The antenna 100 outwardly radiates a radio signal transmitted from the transceiver 200, receives the signal from another source and provides the received signal to the transceiver 200. In an embodiment of the present disclosure, the antenna 100 may include one of a $4^{th}$ generation (4G) long term evolution (LTE) antenna, a global positioning system (GPS) antenna, and a Wi-Fi antenna. In an embodiment of the present disclosure, the antenna 100 may transmit/receive a signal of a 60 gigahertz (GHz) by using a millimeter wave (mmWave) technique.

The transceiver 200 delivers a radio signal to the antenna 100 to be transmitted, and receives a radio signal received through the antenna 100. The transceiver 200 includes a radio frequency (RF) processing function and/or a baseband (BB) processing function.

The transceiver 200 transmits and receives a signal through a wireless channel by performing signal band conversion, amplification, and the like. For this, the transceiver 200 up-converts a baseband signal into an RF signal, and down-converts an RF signal received through the antenna 100 into a baseband signal. The transceiver 200 may include a transmission filter, a reception filter, an amplifier, a mixer, an oscillator, a digital to analog converter (DAC), an analog to digital converter (ADC), and the like. The transceiver 200 may include a plurality of RF chains. Further, the transceiver 200 may support beamforming. For the beamforming, the transceiver 200 may adjust a phase and size of signals transmitted and/or received through a plurality of antennas or antenna elements.

The transceiver 200 including the baseband processing function that converts between a baseband signal and a bit-stream according to a physical layer protocol of a system. For example, in a data transmission process, the transceiver 200 generates complex symbols by coding and modulating a bit-stream. In addition, in a data reception process, the transceiver 200 restores a bit-stream by demodulating and decoding a baseband signal.

The transceiver 200 may be referred to as a transmission unit, a reception unit, a transceiver unit, or a communication unit. The transceiver 200 may be referred to as an RF processor, and may include a BB processor and the RF processor. At least one of the baseband processor and the RF processor may include communication modules to support different communication protocols. Further, at least one of the baseband processor and the RF processor may include different communication modules to process signals of different frequency bands. For example, communication protocols may include a wireless local area network (LAN) (e.g., Institute of Electrical and Electronics Engineers (IEEE) 802.11), a cellular network (e.g., LTE), and the like. Further, the frequency bands may include a super high frequency (SHF) (e.g., 2.5 GHz, 5 GHz) band and an mmWave (e.g., 60 GHz) band.

Figure 2:
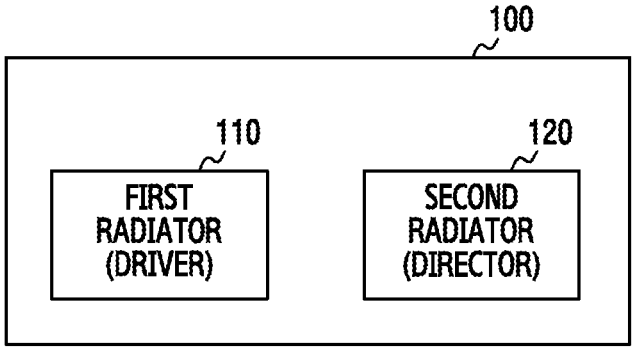
FIG. 2 is a block diagram of an antenna according to various embodiments of the present disclosure.

FIG. 2 is a block diagram of an antenna according to various embodiments of the present disclosure. It will be described for example that this structure is included in the antenna 100 of FIG. 1.

Referring to FIG. 2, the antenna 100 includes a first radiator 110 and a second radiator 120. The first radiator 110 radiates a radio signal and functions as a driver for driving the second radiator 120. The second radiator 120, which faces the first radiator 110 and is installed onto a cover of a wireless device to be separated from the first radiator 110, radiates a radio signal radiated by the first radiator 110. The second radiator 120 functions as a director for determining a radiation direction of the radio signal.

The first radiator 110 includes a feeding unit, a ground plane, and an antenna pattern. The antenna pattern may include an array antenna pattern. In an embodiment of the present disclosure, the antenna pattern may include a plurality of capacitively coupled patterns. In an embodiment of the present disclosure, the antenna pattern may include patterns having a different polarization characteristic. For example, the antenna pattern may include at least one of an inverted-F antenna (IFA) pattern, a dipole antenna pattern, a loop antenna pattern, and a helical antenna pattern.

In an exemplary embodiment of the present disclosure, the first radiator 110 includes a linear radiator. The first radiator 110 may be included in a main body of the wireless device 10. For example, the first radiator 110 may be included in a printed circuit board (PCB) built in the main body of the wireless device 10.

In an embodiment of the present disclosure, the second radiator includes a non-linear radiator (i.e., a non-planar radiator or a curved radiator). The second radiator 120 may include one or more conductive parasitic patches located in predetermined positions of the cover of the wireless device 10. The position of the cover may be determined based on a separation distance between the first radiator 110 and the second radiator 120, a radius of curvature of the second radiator, and a wavelength corresponding to a radio signal. The cover may include at least one material among PCB, silicon, low temperature co-fired ceramic (LTCC), and liquid crystal polymer (LCP).

FIGS. 3, 4, 5, 6A, 6B, 6C, and 6D are drawings illustrating a structure of an antenna according to various embodiments of the present disclosure. These drawings illustrate for example the structure of the first radiator 110 and the second radiator 120 of FIG. 2 and are not necessarily drawn to scale. The structure illustrated herein is for exemplary purposes only and can be modified.

Figure 3:
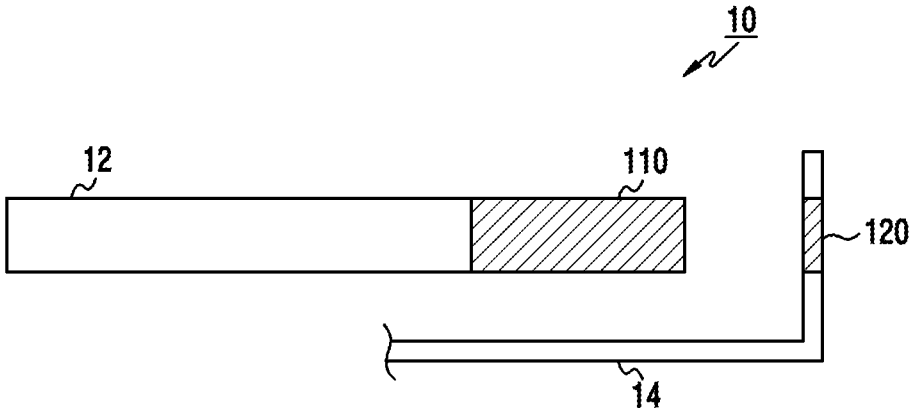
FIG. 3 is a cross-sectional view of an antenna according to various embodiments of the present disclosure.
Figure 4:
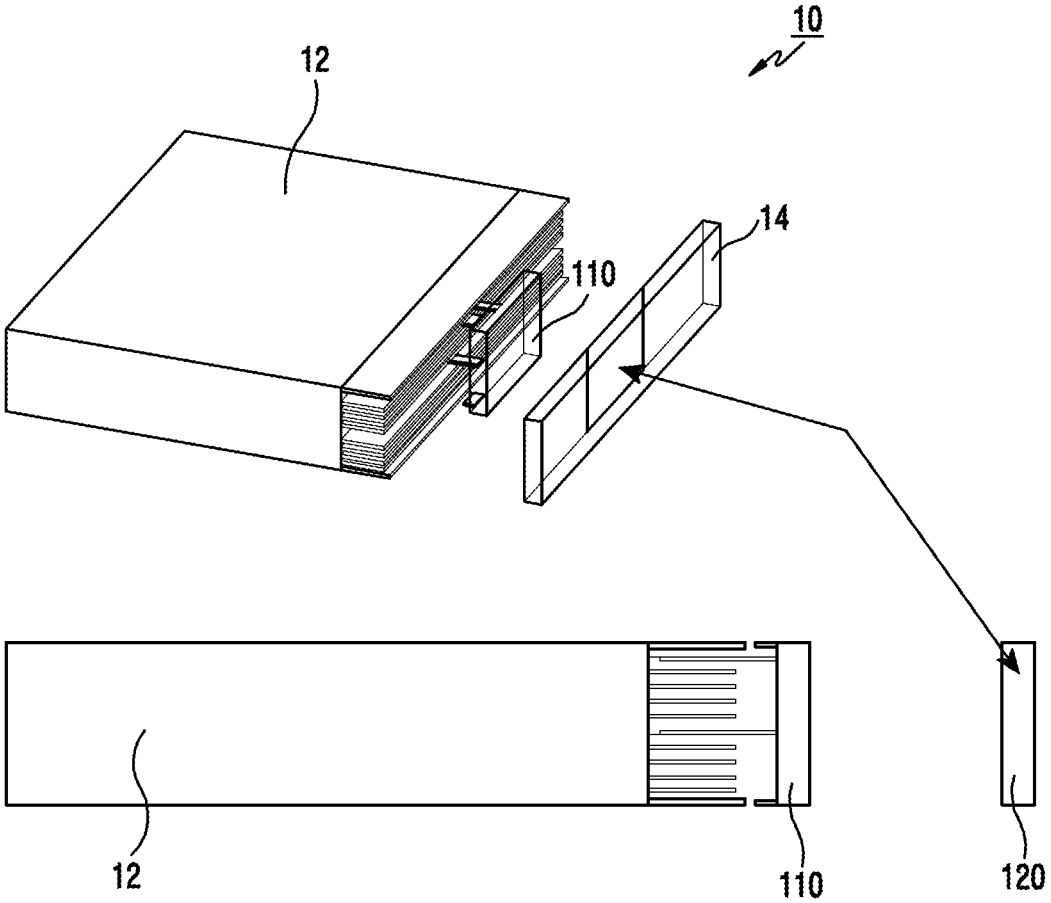
FIG. 4 is a perspective view and cross-sectional view of an antenna according to various embodiments of the present disclosure.

FIG. 3 is a cross-sectional view of an antenna according to various embodiments of the present disclosure, and FIG. 4 is a perspective view and cross-sectional view of an antenna according to various embodiments of the present disclosure.

Referring to FIGS. 3 and 4, the first radiator 110 is included in a PCB 12 disposed in the main body of the wireless device 10. The second radiator 120 is included in a cover (or case) 14 of the wireless device 10. The second radiator 120 is installed by being separated from and facing the first radiator 110 to radiate a radio signal radiated by the first radiator 110. That is, the second radiator 120 is a non-contact radiator that does not physically contact the first radiator 110. The cover 14 may include at least one material among a PCB, silicon, LTCC, and LCP.

The first radiator 110 includes a feeding unit, a ground plane, and an antenna pattern. The antenna pattern radiates a radio signal from the transceiver 200. In an embodiment of the present disclosure, the antenna pattern may include an array antenna pattern. In an embodiment of the present disclosure, the antenna pattern may include a plurality of capacitively coupled patterns. In an embodiment of the present disclosure, the antenna pattern may include patterns having a different polarization characteristic. For example, the antenna pattern may include at least one of an IFA pattern, a dipole antenna pattern, a loop antenna pattern, and a helical antenna pattern.

In an embodiment of the present disclosure, the first radiator 110 may include a linear radiator.

In an embodiment of the present disclosure, the second radiator 120 may include at least one of the linear radiator and a non-linear radiator.

Figure 5:
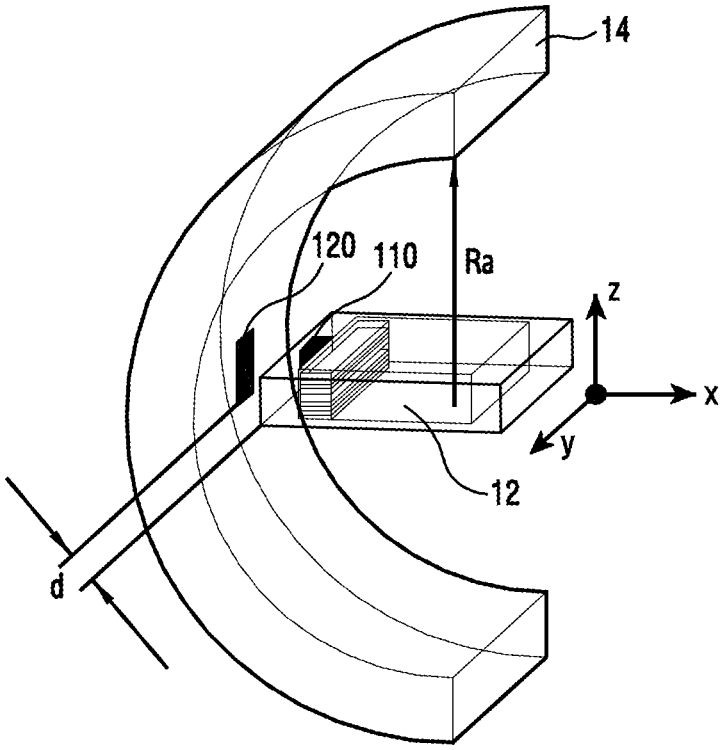
FIG. 5 is a sectional view of a first antenna and a second antenna according to various embodiments of the present disclosure.

FIG. 5 is a sectional view of a first antenna and a second antenna according to various embodiments of the present disclosure.

Referring to FIG. 5, the first radiator 110 is a linear radiator, and the second radiator 120 is a non-linear radiator. The second radiator 120 may include one or more conductive parasitic patches located in predetermined positions of the cover 14. The location of the conductive parasitic patch may be determined on the basis of a separation distance d between the first radiator 110 and the second radiator 120, a radius of curvature Ra of the second radiator 120, and a wavelength λ corresponding to a frequency f of a radio signal. For example, the second radiator 120 may be located in a predetermined separation distance (e.g., 0.2 lambda~1 lambda) while being parallel to a surface of the first radiator 110.

FIGS. 6A, 6B, 6C, and 6D are drawings illustrating a structure of a wireless device including an antenna according to various embodiments of the present disclosure.

Figure 6A:
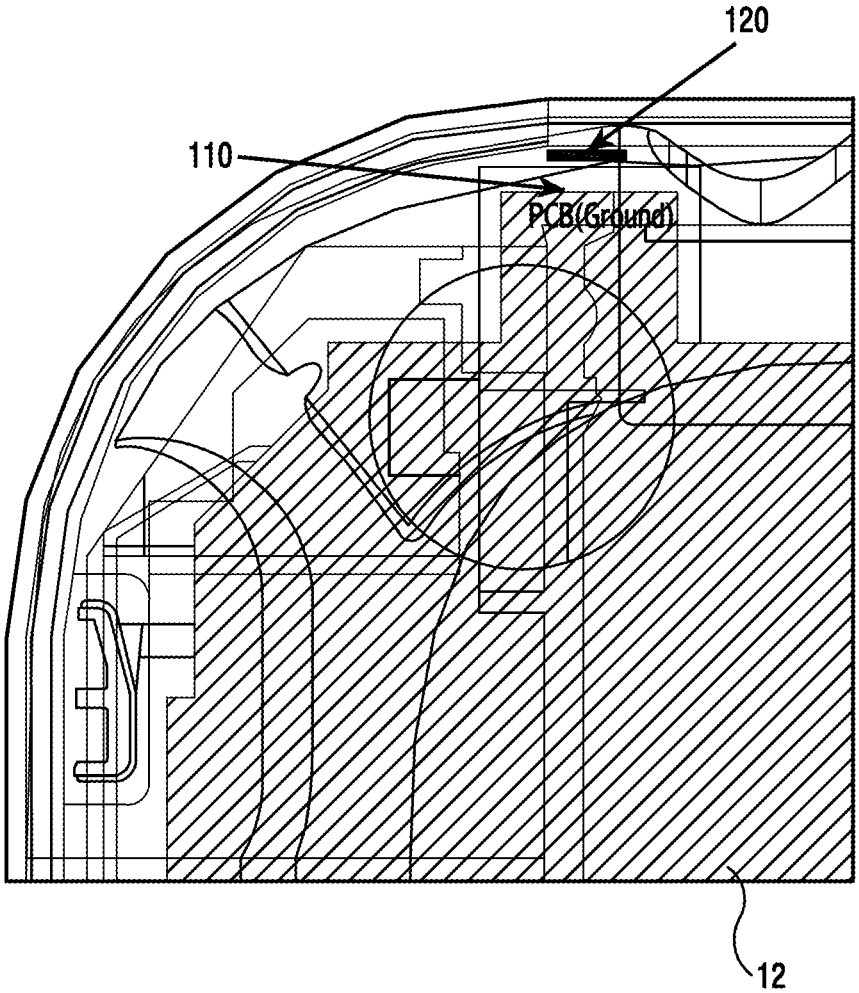
FIGS. 6A, 6B, 6C, and 6D are drawings illustrating a structure of a wireless device including an antenna according to various embodiments of the present disclosure.
Figure 6B:
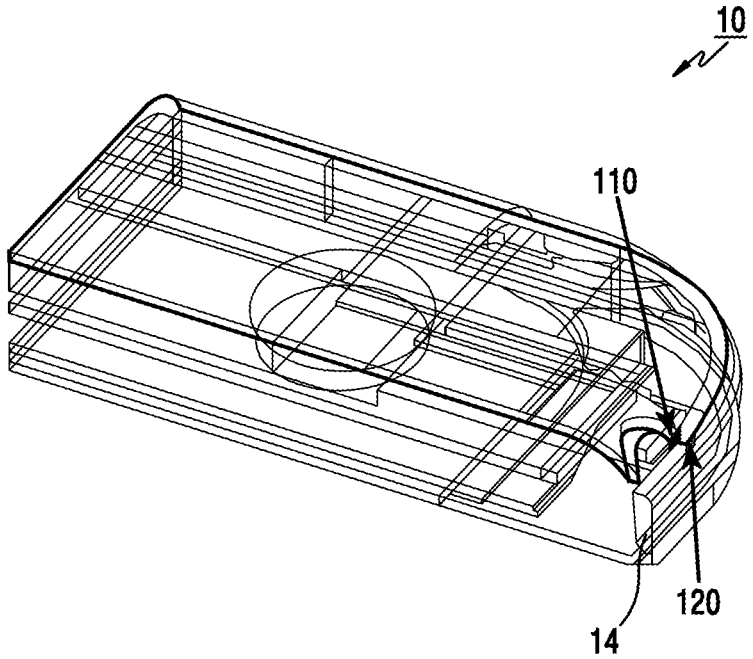
Figure 6C:
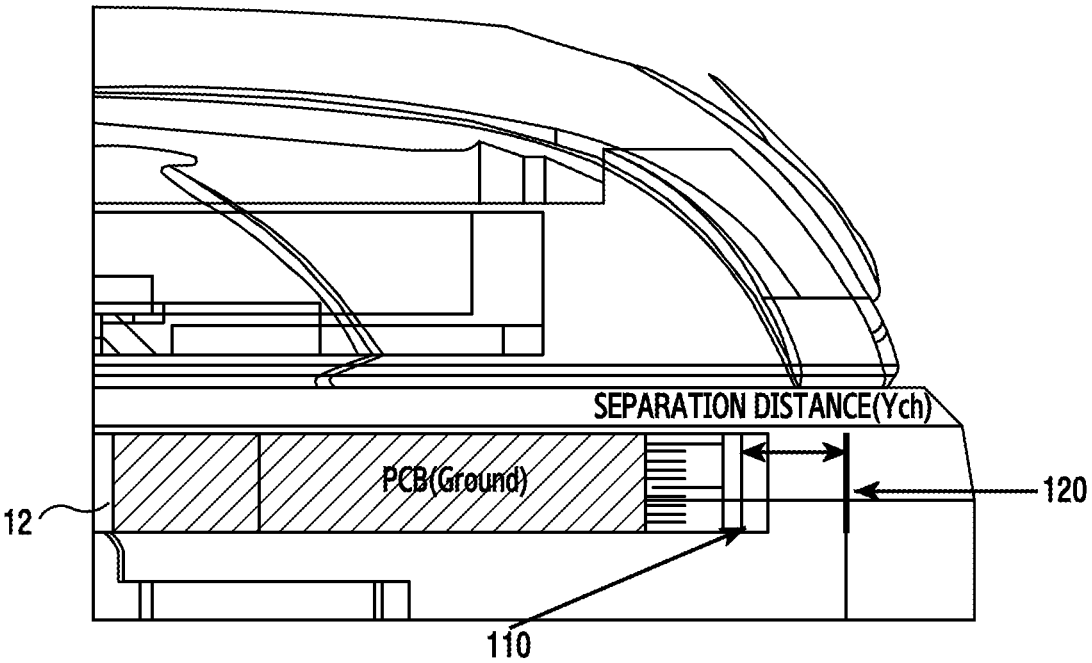
Figure 6D:
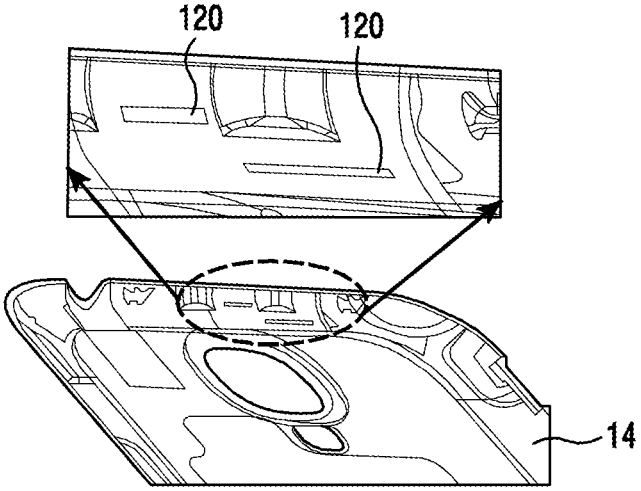

FIG. 6A, a top view of a wireless device including an antenna according to various embodiments of the present disclosure. FIG. 6B is a perspective view (or three-dimensional (3D) view) of a wireless device including an antenna according to various embodiments of the present disclosure. FIG. 6C is a side view of a wireless device including an antenna according to various embodiments of the present disclosure. FIG. 6D is a view illustrating an exterior of a cover of a wireless device including an antenna according to various embodiments of the present disclosure.

Referring to FIGS. 6A, 6B, 6C, and 6D, the cover 14 of the wireless device 10 includes the second radiator 120. The second radiator 120 faces the first radiator 110 and is separated by a separation distance Ych from the first radiator 110. The first radiator 110 is included in the PCB 12, and the PCB 12 includes a ground plane. As such, the antenna according to various embodiments of the present disclosure incorporates a part of the cover (or case) as a part of the radiator to perform signal transmission/reception. With the advancement of manufacturing technologies, it is possible to form a conductive parasitic patch at a specific position of the cover of the wireless device. For example, the conductive parasitic patch may be formed at the specific position of the cover of the wireless device through bi-injection molding, 3D printing, laser direct structuring (LDS), and the like.

Figure 7A:
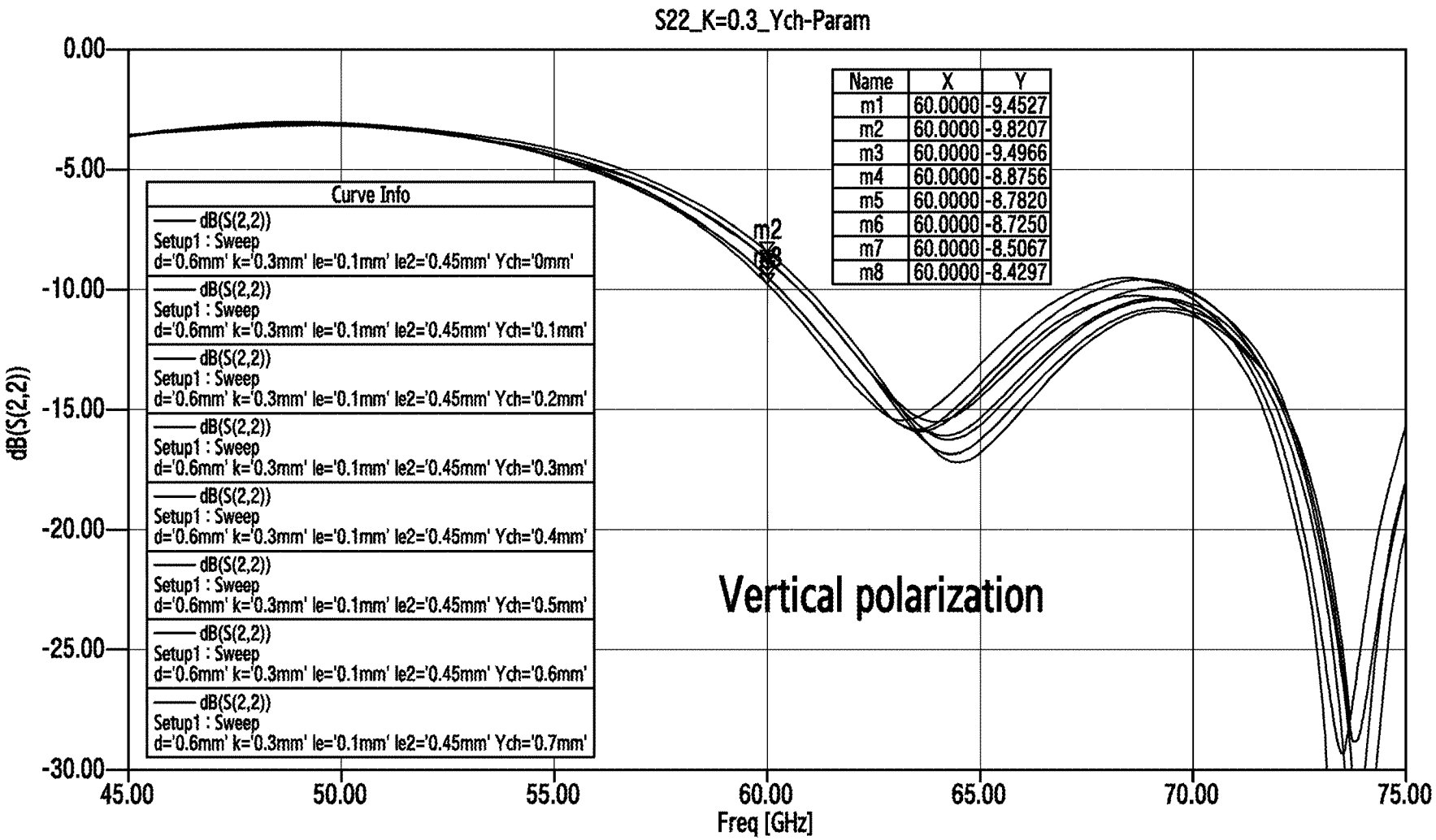
FIGS. 7A and 7B are graphs illustrating a vertical polarization and a horizontal polarization according to various embodiments of the present disclosure.
Figure 7B:
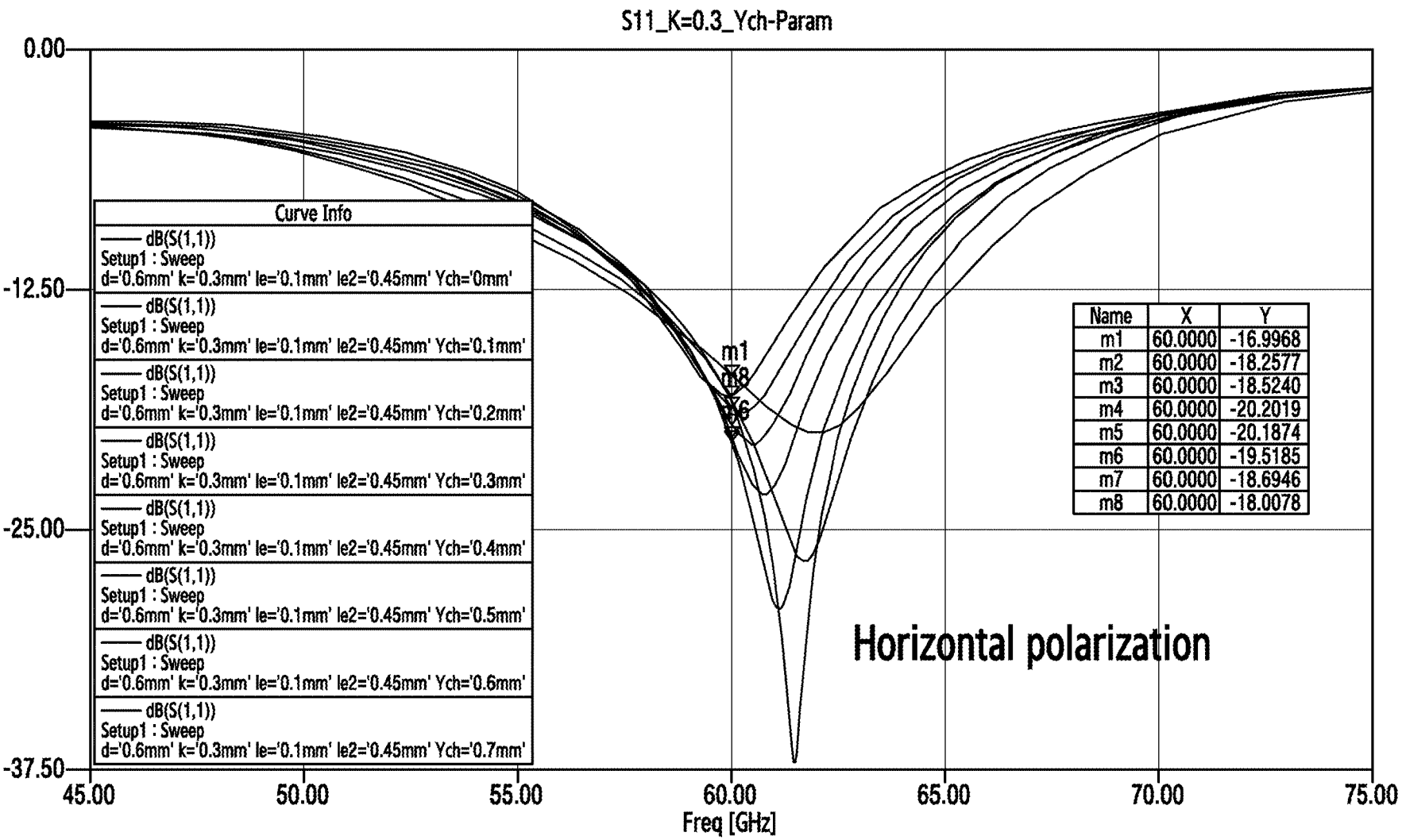

FIGS. 7A and 7B are graphs illustrating a vertical polarization and a horizontal polarization according to various embodiments of the present disclosure.

Referring to FIGS. 7A and 7B, the antenna according to various embodiments of the present disclosure can support vertical polarization and horizontal polarization depending on a shape of the second radiator 120. Graphs of the vertical polarization and horizontal polarization shown in FIGS. 7A and 7B illustrate that the vertical polarization and the horizontal polarization are different with respect to a radio signal of a specific frequency band (e.g., 60 GHz), depending on a separation distance (e.g., 0.2 lambda (λ)~1 lambda (λ)) between the first radiator 110 and the second radiator 120. Table 1 illustrates a gain characteristic over frequency for the horizontal polarization, depending on a separation distance Ych between the first radiator 110 and the second radiator 120.

TABLE 1

| Ych (mm) | 0.3 | 0.4 | 0.5 | 0.6 | 0.7 |
|---|---|---|---|---|---|
| Gain (dBi) | 5.65 | 5.78 | 6.0 | 5.92 | 5.95 |

Figure 8:
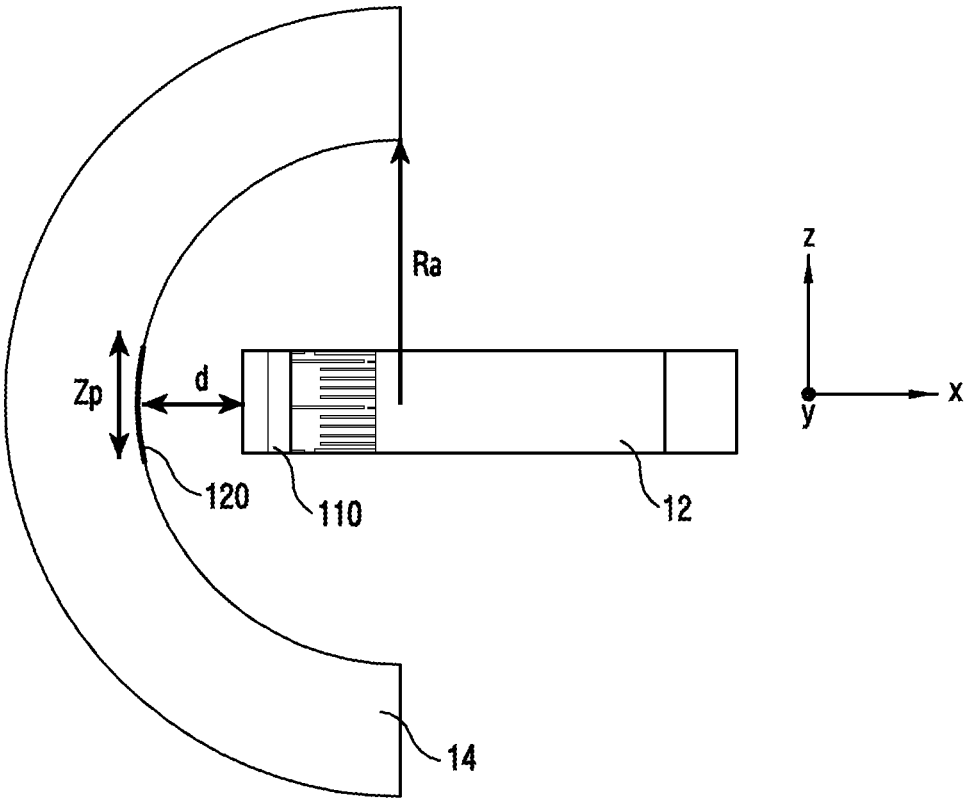
FIG. 8 illustrates a structure of an antenna according to an embodiment of the present disclosure.

FIG. 8 illustrates a structure of an antenna according to an embodiment of the present disclosure.

Referring to FIG. 8, the second radiator 120 has a symmetric-aligned structure with respect to the first radiator 110. Herein, symmetric means that the second radiator 120 is parallel to a surface of the first radiator 110, and aligned means that a center position of the first radiator 110 is aligned with a center position of the non-linear cover 14. The second radiator 120 is separated by a distance d from the first radiator 110, and the non-linear cover 14 including the second radiator 120 has a radius of curvature Ra. The second radiator 120 has a length Zp.

FIGS. 9A, 9B, 9C, and 9D are graphs illustrating a gain obtained by an antenna according to various embodiments of the present disclosure.

Figure 9A:
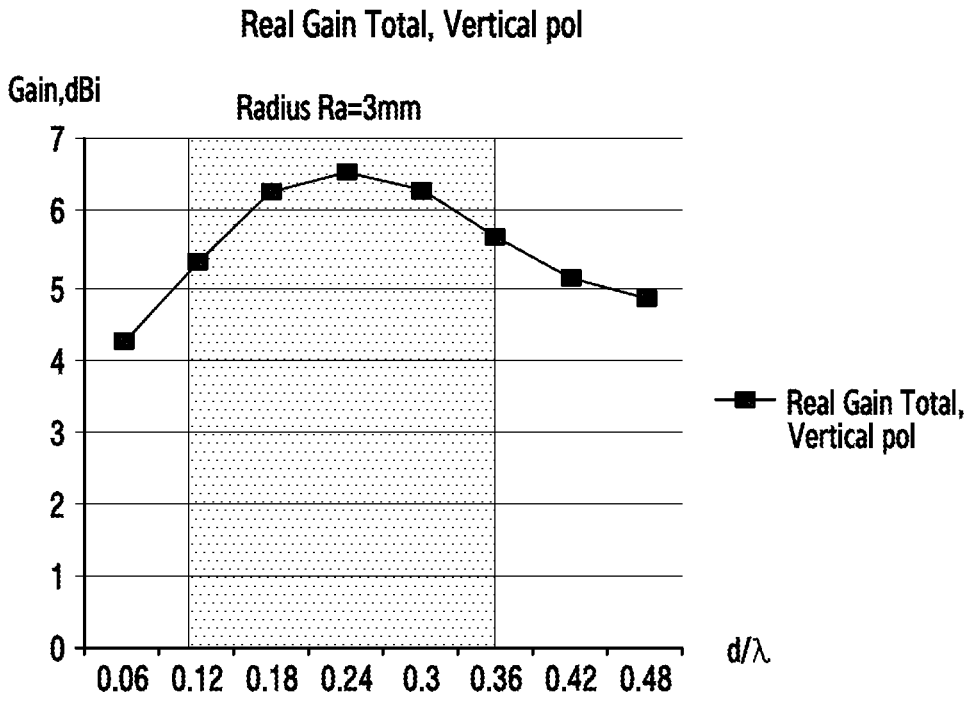
FIGS. 9A, 9B, 9C, and 9D are graphs illustrating a gain obtained by an antenna according to various embodiments of the present disclosure.

Referring to FIG. 9A, if a radius of curvature Ra of the cover 14 is 3 mm, a vertical polarization gain is based on a change of d/λ, i.e., a ratio of a separation distance d to a wavelength λ. For example, if d/λ is 0.12, the vertical polarization gain is about 5.4 dBi. If d/λ is 0.24, the vertical polarization gain is about 6.6 dBi. If d/λ is 0.36, the vertical polarization gain is about 5.8 dBi. In an embodiment of the present disclosure, the ratio d/λ of the separation distance d (i.e., the distance between the first radiator 110 and the second radiator 120) to the wavelength λ may be in the range of 0.02 to 0.4.

Figure 9B:
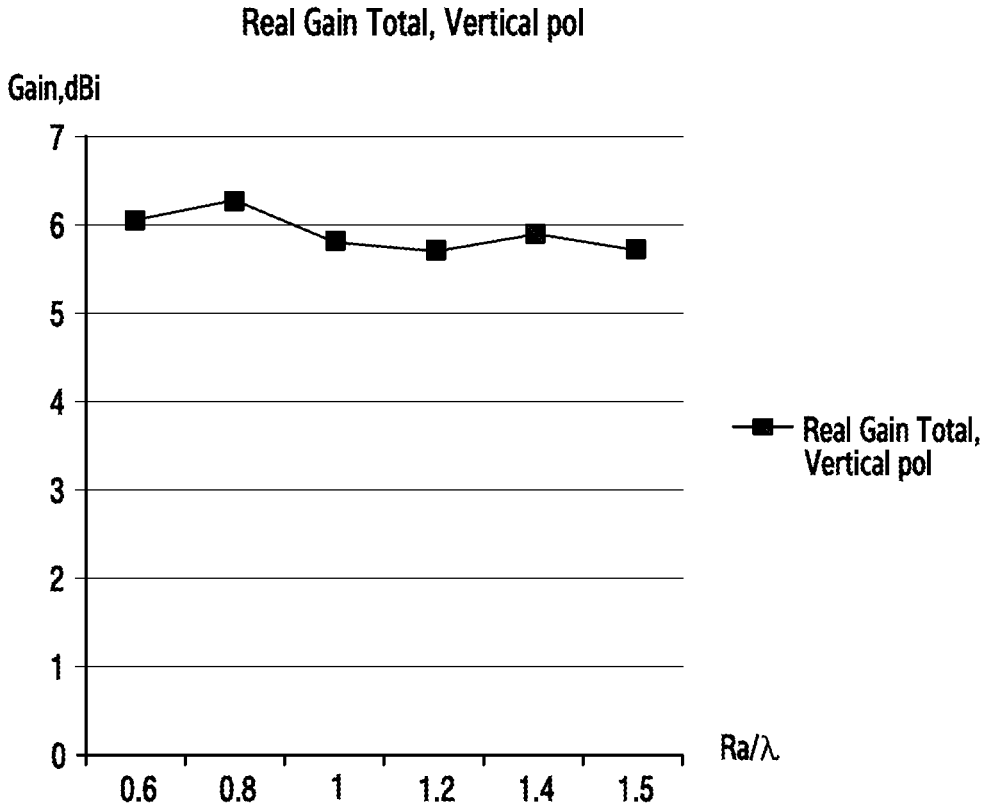

Referring to FIG. 9B, a vertical polarization gain is based on a change of Ra/λ, i.e., a ratio of a radius of curvature Ra to a wavelength λ. For example, if Ra/λ is 0.8, the vertical polarization gain is about 6.3 dBi. If Ra/λ, is 1, the vertical polarization gain is about 5.9 dBi. If Ra/λ, is 1.2, the vertical polarization gain is about 5.8 dBi. Thus, the ratio Ra/λ of the radius of curvature to the wavelength does not have a significant effect on design of the device.

Figure 9C:
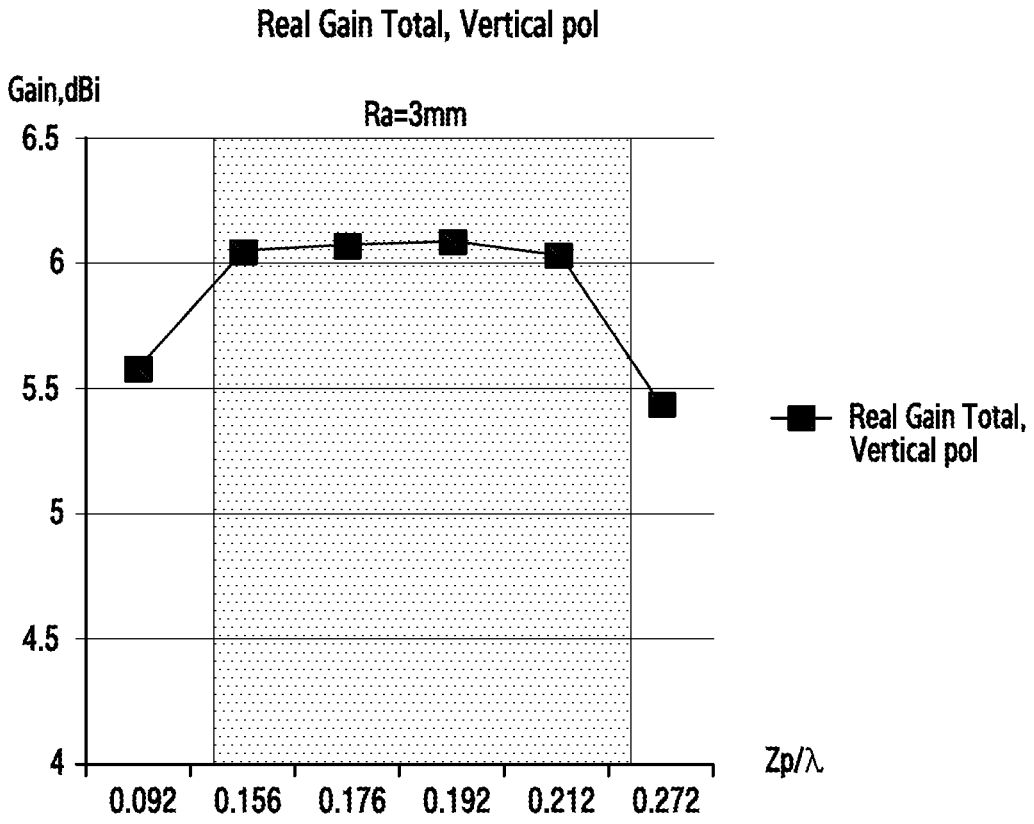

Referring to FIG. 9C, if a radius of curvature Ra of the cover 14 is 3 mm, a vertical polarization gain is based on a change of Zp/λ, i.e., a ratio of a length Zp (i.e., the second radiator 120) to a wavelength λ. For example, if Zp/λ is 0.092, the vertical polarization gain is about 5.6 dBi. If Zp/λ is 0.156, 0.176, 0.192, or 0.212, the vertical polarization gain is about 6.1 dBi. If Zp/λ is 0.272, the vertical polarization gain is about 5.4 dBi. In an embodiment of the present disclosure, the ratio Zp/λ of the length Zp to the wavelength λ may be in the range of 0.1 to 0.3.

Figure 9D:
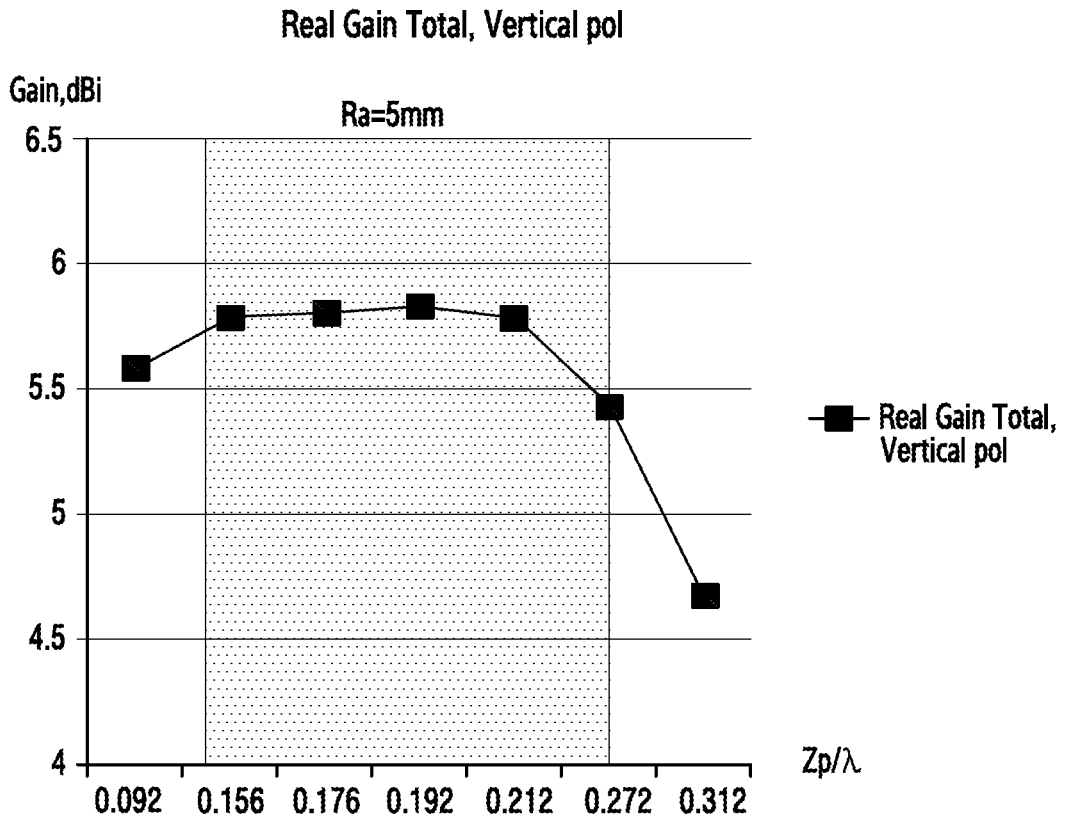

Referring to FIG. 9D, if a radius of curvature Ra of the cover 14 is 5 mm, a vertical polarization gain is based on a change of Zp/λ, i.e., a ratio of a length Zp (i.e., the second radiator 120) to a wavelength λ. For example, if Zp/λ is 0.092, the vertical polarization gain is about 5.6 dBi. If Zp/λ is 0.156, 0.176, 0.192, or 0.212, the vertical polarization gain is about 5.8 dBi. If Zp/λ is about 0.272, the vertical polarization gain is about 5.4 dBi. In an embodiment of the present disclosure, the ratio Zp/λ of the length Zp to the wavelength λ may be in the range of 0.1 to 0.3.

Figure 10:
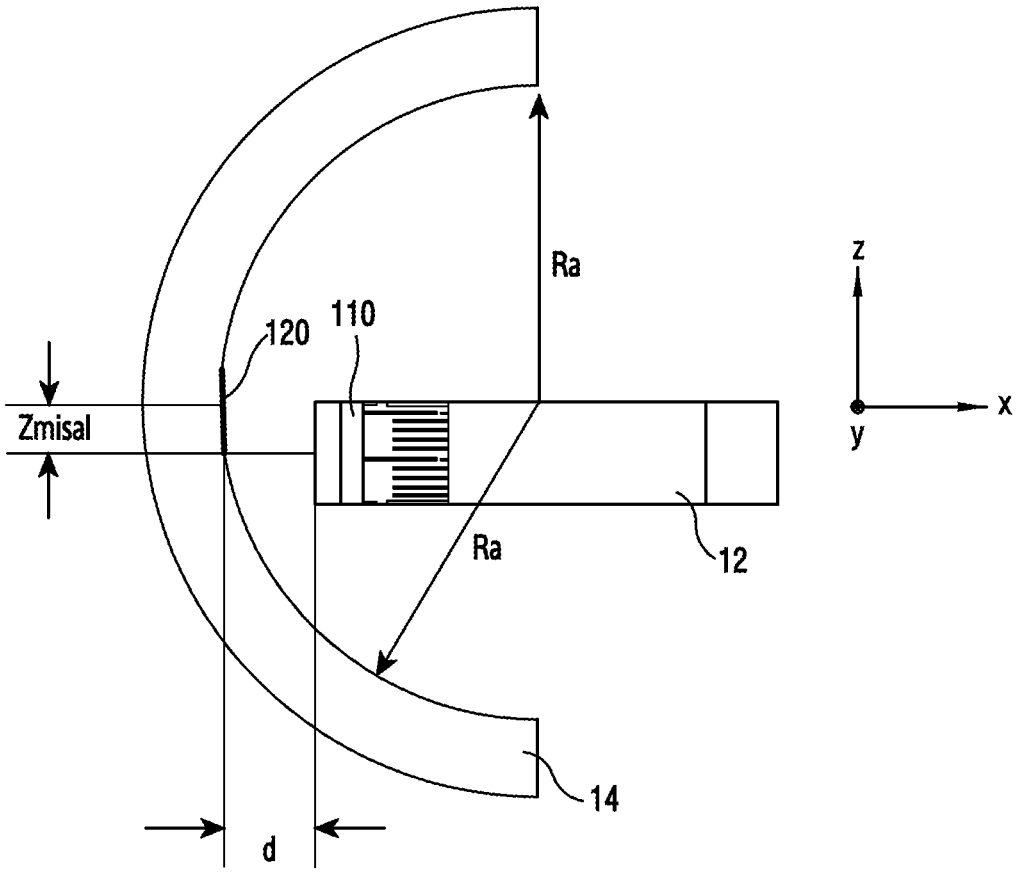
FIG. 10 illustrates a structure of an antenna according to an embodiment of the present disclosure.

FIG. 10 illustrates a structure of an antenna according to an embodiment of the present disclosure.

Referring to FIG. 10, the second radiator 120 has a symmetric-misaligned structure with respect to the first radiator 110. Herein, symmetric means that a surface of the second radiator 120 is parallel to a surface of the first radiator 110, and misaligned means that a center position of the first radiator 110 is not aligned with a center position of the non-linear cover 14. The second radiator 120 is separated by a distance d from the first radiator 110, and the non-linear cover 14 including the second radiator 120 has a radius of curvature Ra. The second radiator 120 is located in a center position of the cover 14. A center position of the first radiator 110 is misaligned by distance Zmisal from the center position of the cover 14.

Figure 11A:
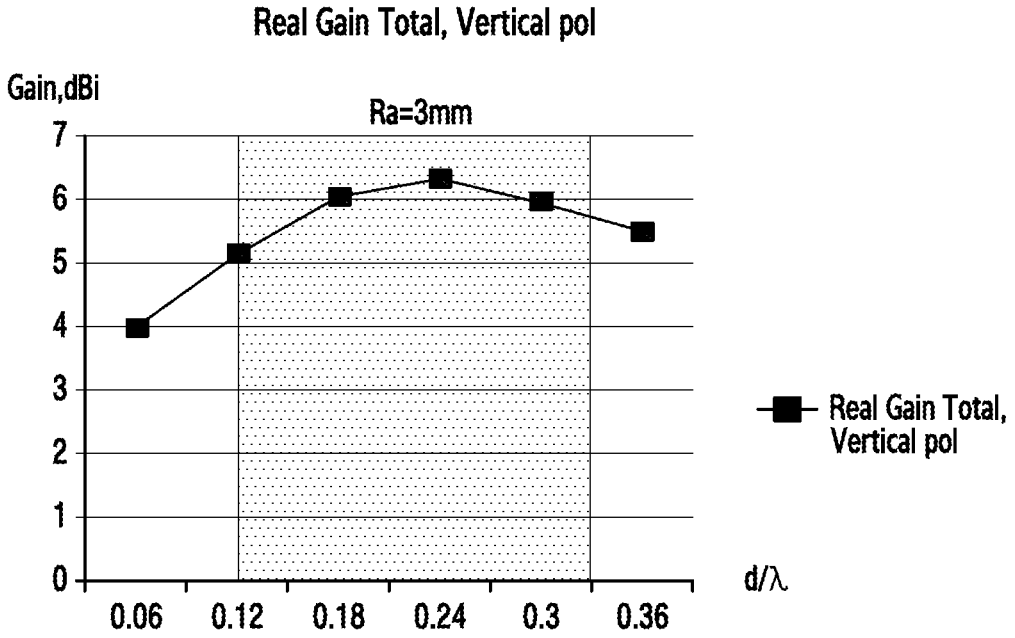
FIGS. 11A and 11B are graphs illustrating a gain obtained by an antenna according to various embodiments of the present disclosure.
Figure 11B:
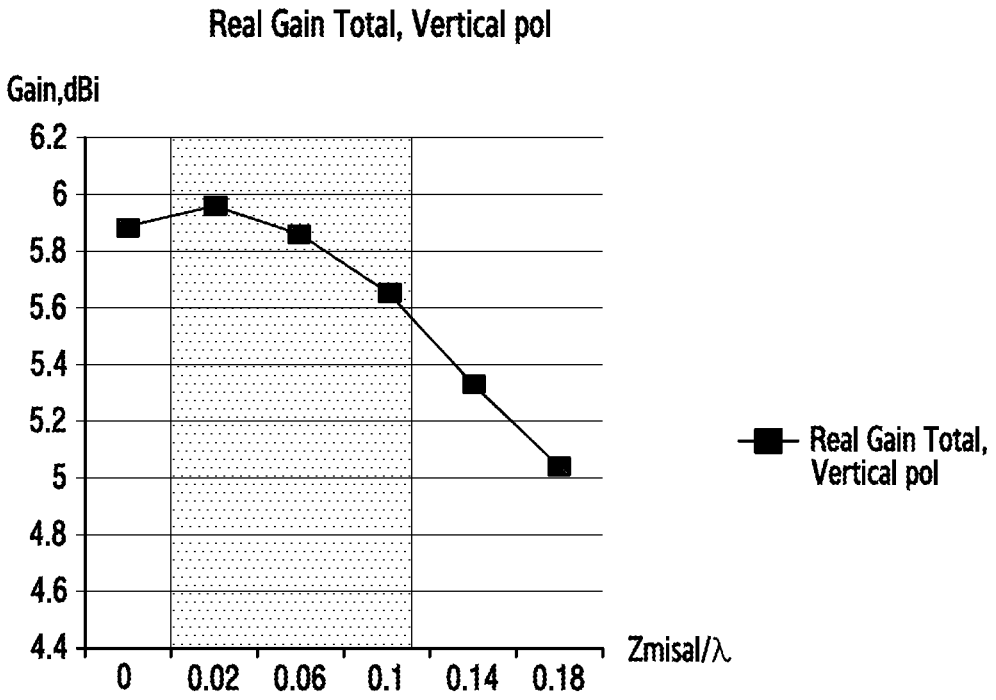

FIGS. 11A and 11B are graphs illustrating a gain obtained by an antenna according to various embodiments of the present disclosure.

Referring to FIG. 11A, if a radius of curvature Ra of the cover 14 is 3 mm, a vertical polarization gain is based on a change of d/λ, i.e., a ratio of a separation distance d to a wavelength λ. For example, if d/λ is 0.12, the vertical polarization gain is about 5 dBi. If da is 0.24, the vertical polarization gain is about 6.3 dBi. If da is 0.36, the vertical polarization gain is about 5.5 dBi. In an embodiment of the present disclosure, the ratio d/λ of the separation distance d (i.e., the distance between the first radiator 110 and the second radiator 120) to the wavelength λ may be in the range of 0.02 to 0.4.

Referring to FIG. 11B, a vertical polarization gain is based on a change of Zmisal/λ, i.e., a ratio of a misalignment distance Zmisal (i.e., a distance of a center position of the first radiator 110 and a center position of the cover 14) to a wavelength λ. For example, if Zmisal/λ is 0.02, the vertical polarization gain is about 5.95 dBi. If Zmisal/λ is 0.06, the vertical polarization gain is about 5.82 dBi. If Zmisal/λ is 0.1, the vertical polarization gain is about 5.64 dBi.

Figure 12:
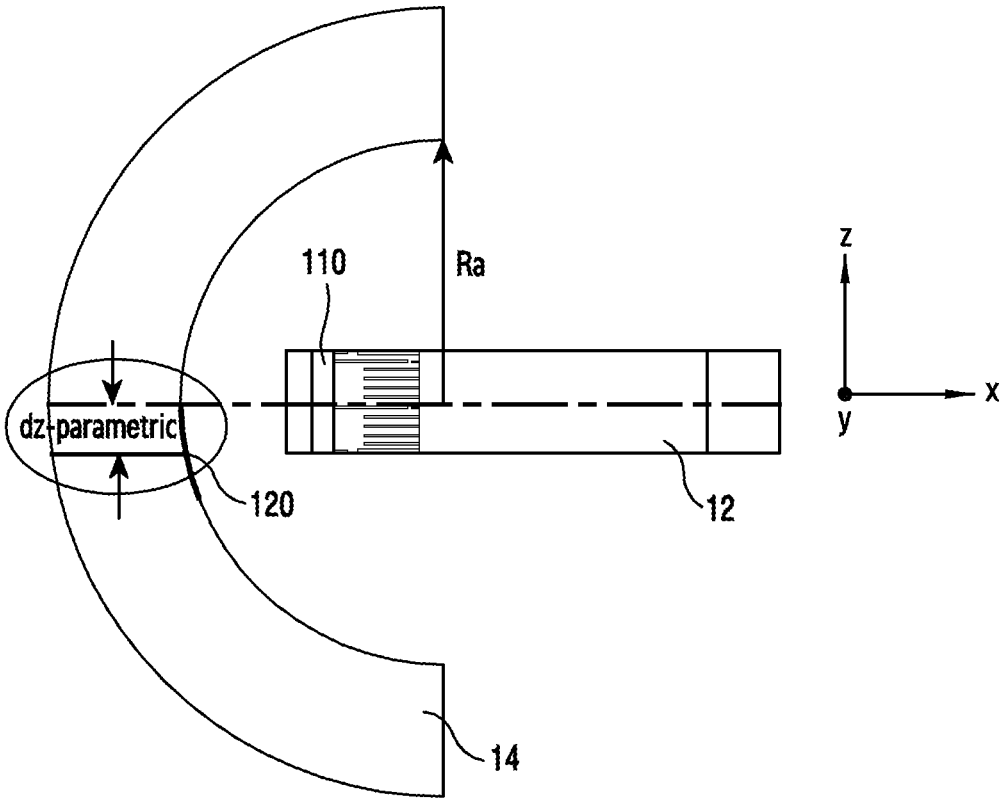
FIG. 12 illustrates a structure of an antenna according to an embodiment of the present disclosure.

FIG. 12 illustrates a structure of an antenna according to an embodiment of the present disclosure.

Referring to FIG. 12, the second radiator 120 has an asymmetric-aligned structure with respect to the first radiator 110. Herein, asymmetric means that the second radiator 120 is not parallel to a surface of the first radiator 110, and aligned means that a center position of the first radiator 110 is aligned with a center position of the non-linear cover 14. The non-linear cover 14 including the second radiator 120 has a radius of curvature Ra. A center position of the second radiator 120 is shifted downwardly by a distance dz from the center position of the cover 14.

Figure 13A:
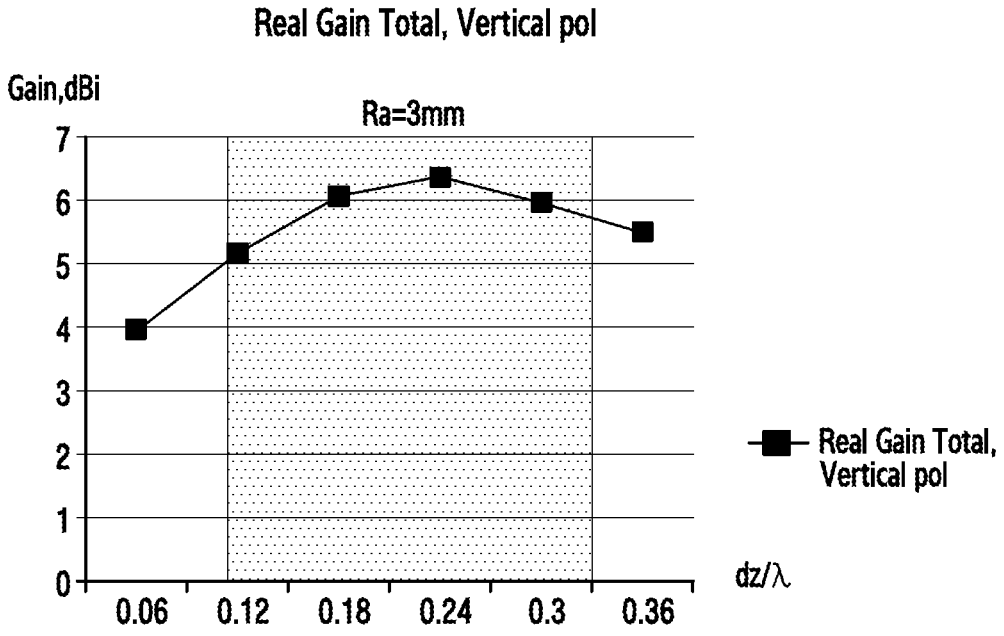
FIGS. 13A and 13B are graphs illustrating a gain obtained by an antenna according to various embodiments of the present disclosure.
Figure 13B:
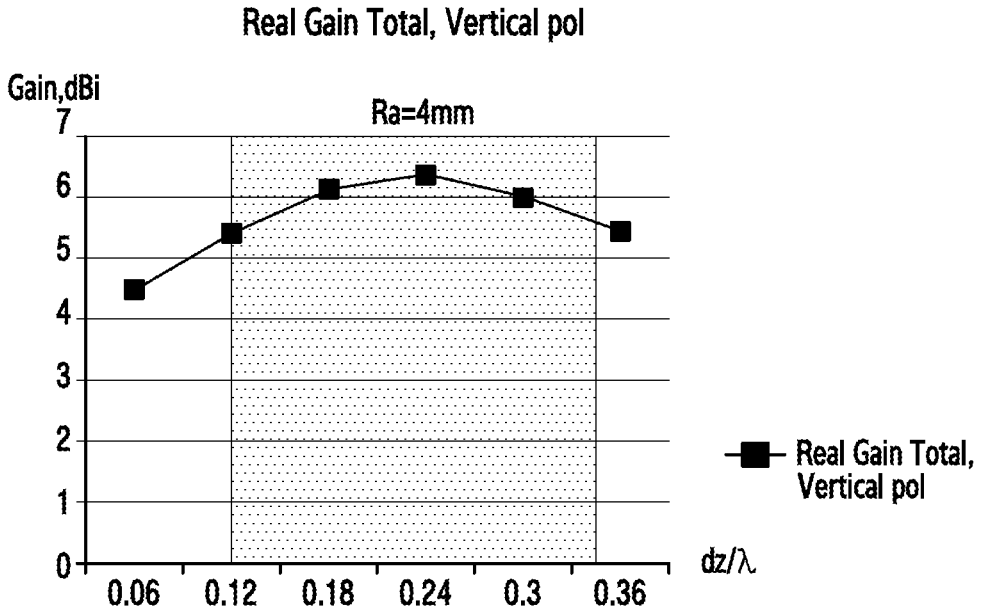

FIGS. 13A and 13B are graphs illustrating a gain obtained by an antenna according to various embodiments of the present disclosure.

Referring to FIG. 13A, if a radius of curvature Ra of the cover 14 is 3 mm, a vertical polarization gain is based on a change of dz/λ, i.e., a ratio of a distance dz (i.e., the distance between a center position of the second radiator 120 and a center position of the cover 14) to a wavelength λ. For example, if dz/λ is 0.12, the vertical polarization gain is about 5.1 dBi. If dz/λ is 0.18, the vertical polarization gain is about 6.1 dBi. If dz/λ is 0.24, the vertical polarization gain is about 6.3 dBi. If dz/λ is 0.36, the vertical polarization gain is about 5.5 dBi. In an embodiment of the present disclosure, the ratio dz/λ, i.e., the ratio of the distance dz (i.e., the distance between the center position of the second radiator 120 and the center position of the cover 14) to the wavelength λ may be determined in the range of 0.02 to 0.4.

Referring to FIG. 13B, if a radius of curvature Ra of the cover 14 is 4 mm, a vertical polarization gain is based on a change of dz/λ, i.e., a ratio of a distance dz (i.e., the distance between a center position of the second radiator 120 and a center position of the cover 14) to a wavelength λ. For example, if dz/λ is 0.12, the vertical polarization gain is about 5.4 dBi. If dz/λ is 0.18, the vertical polarization gain is about 6.1 dBi. If dz/λ is 0.24, the vertical polarization gain is about 6.3 dBi. If dz/λ is 0.36, the vertical polarization gain is about 5.5 dBi. In an embodiment of the present disclosure, the ratio dz/λ of the distance dz (i.e., the distance between the center position of the second radiator 120 and the center position of the cover 14) to the wavelength λ may be determined in the range of 0.02 to 0.4.

Figure 14:
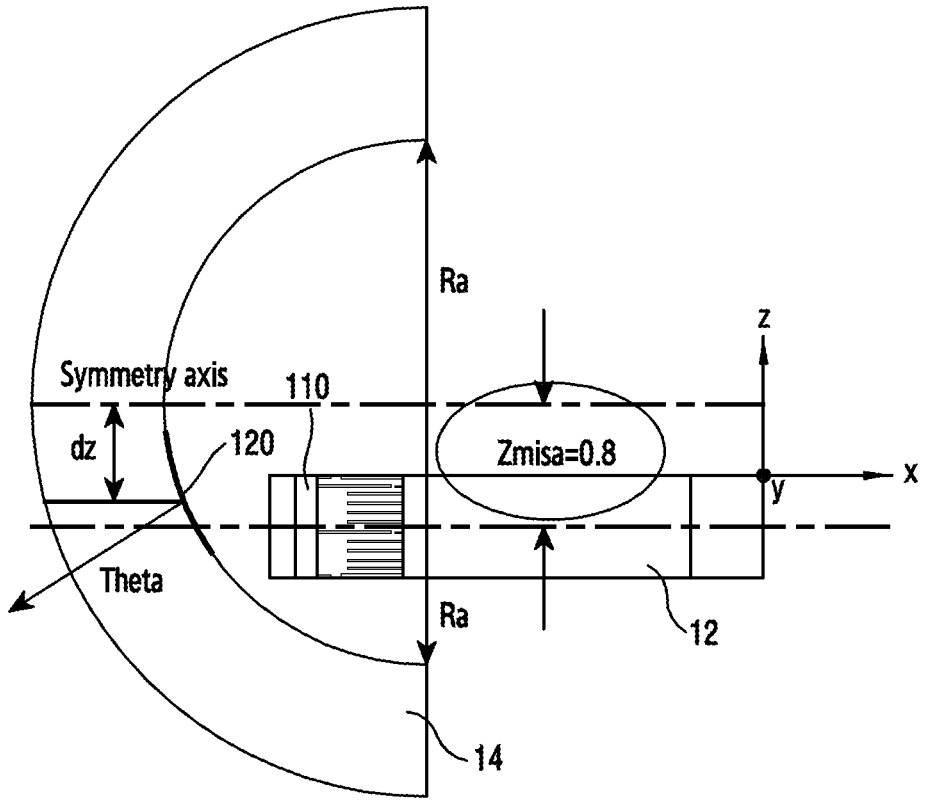
FIG. 14 illustrates a structure of an antenna according to an embodiment of the present disclosure.

FIG. 14 illustrates a structure of an antenna according to an embodiment of the present disclosure.

Referring to FIG. 14, the second radiator 120 has an asymmetric-misaligned structure with respect to the first radiator 110. Herein, asymmetric means that the second radiator 120 is not parallel to a surface of the first radiator 110, and misaligned means that a center position of the first radiator 110 is not aligned with a center position of the non-linear cover 14. The non-linear cover 14 including the second radiator 120 has a radius of curvature Ra. A center position of the second radiator 120 is shifted downwardly by a distance dz from the center position of the cover 14. The center position of the first radiator 110 is shifted downwardly by distance Zmisa (e.g., 0.8) from the center position of the cover 14. An angle theta (θ) is formed by an axis with an origin at the center position of the second radiator 120 and parallel to an axis with an origin at the center position of the cover 14 and by an axis orthogonal to the center position of the second radiator 120. A radio signal is radiated within the angle formed in this manner. For example, if the radio signal is radiated through beamforming, a beam control may be achieved within the formed angle (e.g., 20 degrees) (°).

Figure 15:
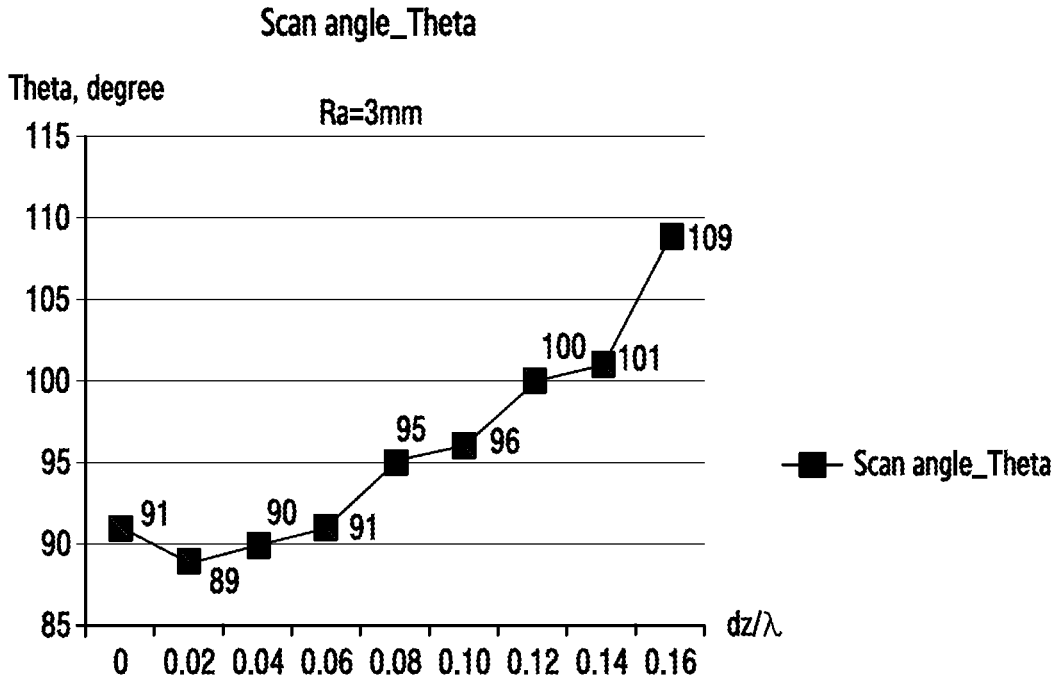
FIG. 15 is a graph illustrating transmission/reception beam control by an antenna according to an embodiment of the present disclosure.

FIG. 15 is a graph illustrating transmission/reception beam control by an antenna according to an embodiment of the present disclosure.

Referring to FIG. 15, if a radius of curvature Ra of the cover 14 is 3 mm, an angle theta (θ), which is formed by an axis with an origin at the center position of the second radiator 120 and parallel to an axis with an origin at the center position of the cover 14 and by an axis orthogonal to the center position of the second radiator 120, varies depending on a change of dz/λ, i.e., a ratio of a distance dz (i.e., the distance between the center position of the second radiator 120 and the center position of the cover 14) to a wavelength λ. For example, if dz/λ is 0.02, the angle theta (θ) is 89 degrees. If dz/λ is 0.06, the angle theta (θ) is 91 degrees. If dz/λ is 0.1, the angle theta (θ) is 96. If dz/λ is 0.16, the angle theta (0) is 109 degrees. In an embodiment, the ratio dz/λ of the difference dz to the wavelength λ may be determined in the range of 0.02 to 0.4.

Figure 16A:
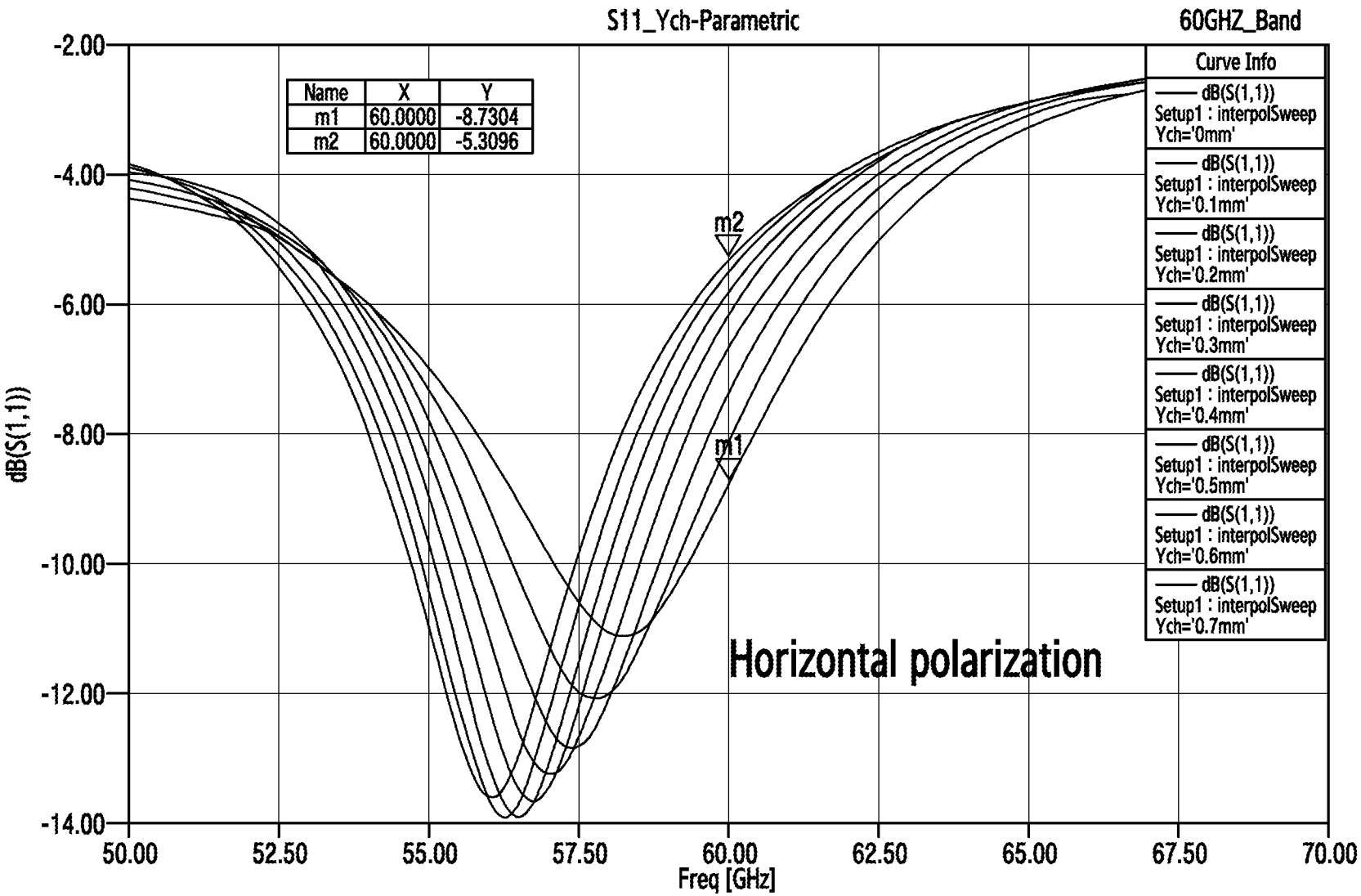
FIGS. 16A and 16B are graphs illustrating gain of an antenna according to various embodiments of the present disclosure.
Figure 16B:
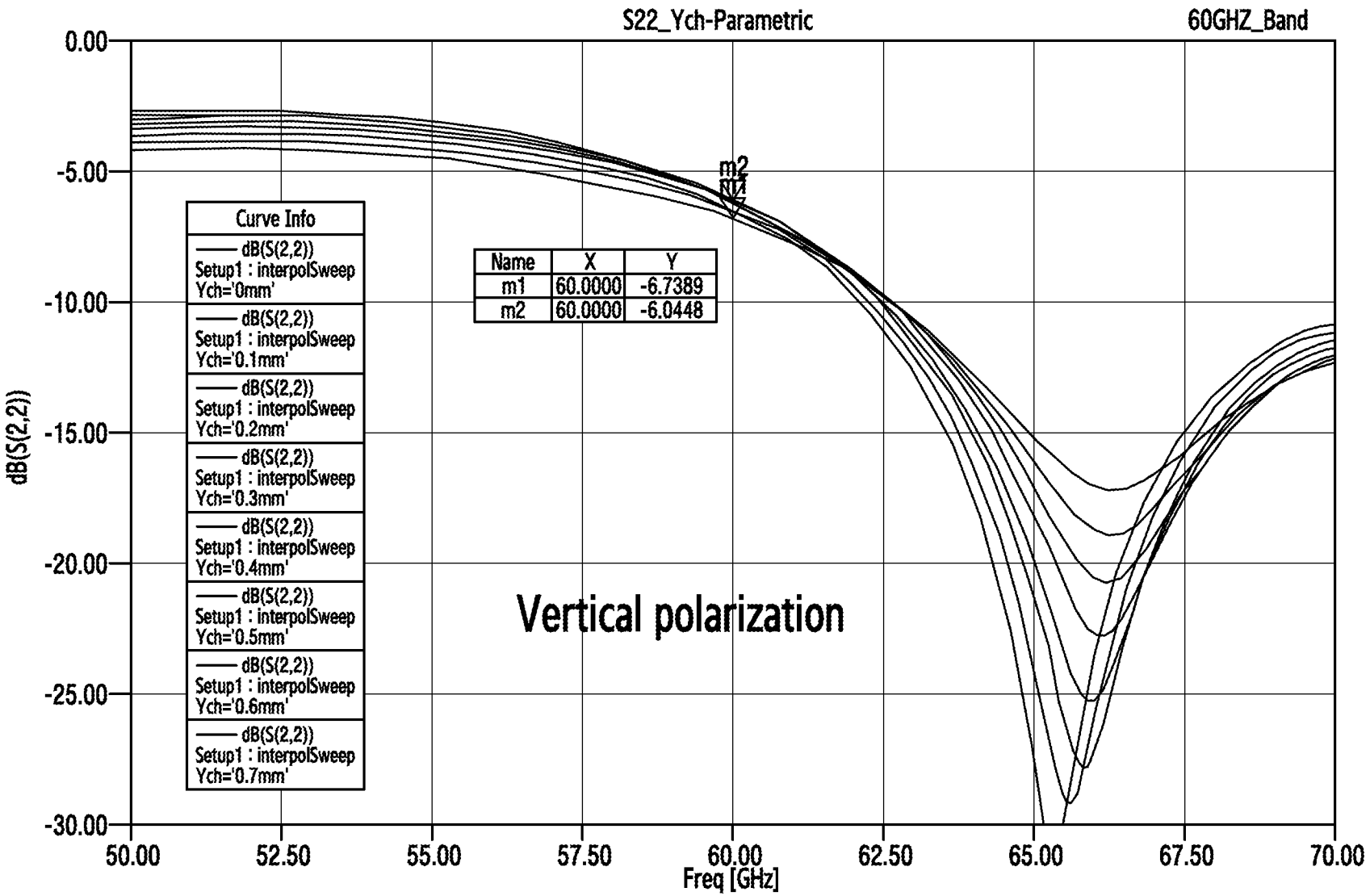

FIGS. 16A and 16B are graphs illustrating gain of an antenna according to various embodiments of the present disclosure.

Referring to FIG. 16A, a horizontal polarization gain is illustrated at a predetermined frequency band (e.g., 60 GHz) by an antenna included in a main body of a wireless device. Point m1 denotes a horizontal polarization gain (−8.7304 dB) when the main body of the wireless device is coupled with a cover, and point m2 denotes a horizontal polarization gain (−5.3096 dB) when the main body of the wireless device is separated (for example, by 0.7 mm) from the cover.

Referring to FIG. 16B, a vertical polarization gain is illustrated at a predetermined frequency band (e.g., 60 GHz) by an antenna included in a main body of a wireless device and a second radiator is included in a cover. Point m1 denotes a vertical polarization gain (−6.7389 dB) when the main body of the wireless device is coupled with the cover, and point m2 denotes a vertical polarization gain (−6.0448 dB) when the main body of the wireless device is separated (for example, by 0.7 mm) from the cover. It can be seen that the antenna according to the various embodiments of the present disclosure has a vertical polarization improved by 1.9 dBi (8.7304 dB-6.7389 dB) in comparison with the antenna of the related art.

FIGS. 17, 18, 19, 20, and 21 illustrate modified structures of an antenna according to various embodiments of the present disclosure.

Figure 17:
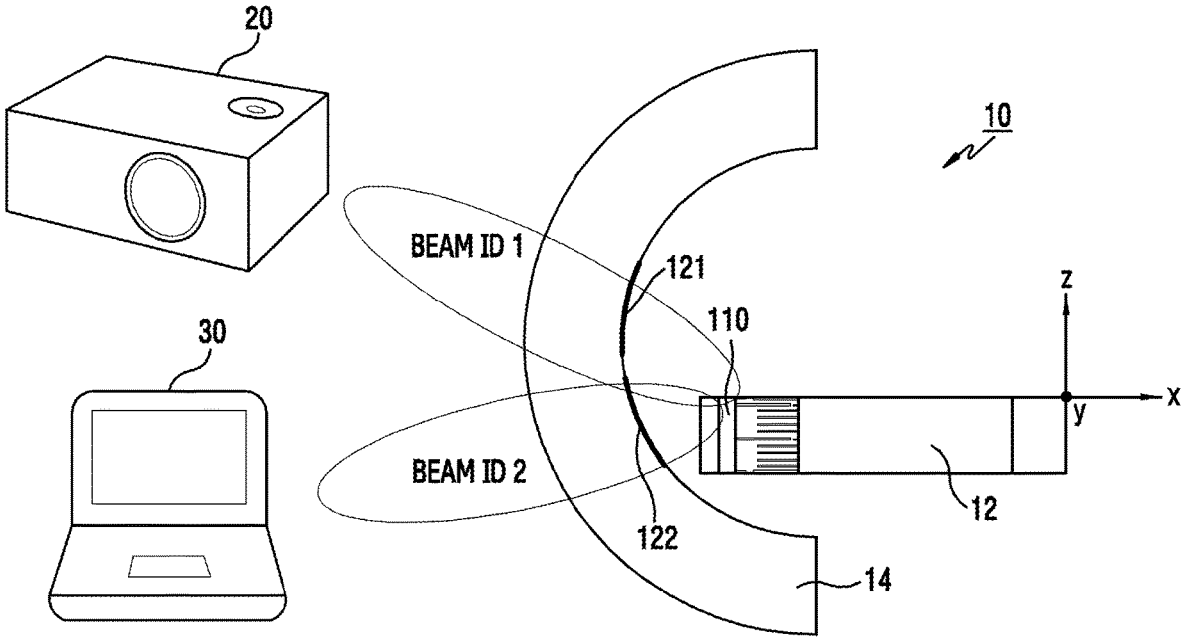
FIGS. 17, 18, 19, 20, and 21 illustrate modified structures of an antenna according to various embodiments of the present disclosure.

Referring to FIG. 17, a first radiator 110 is included in a PCB 12 of a main body of a wireless device 10, and two radiators 121 and 122 are included in a cover 14. An angle of a beam to be radiated can be adjusted depending on positions of the first radiator 110 and the second radiators 121 and 122. The radiator 121 radiates a beam radiated from the first radiator 110 as a beam identification ID 1, so that the beam ID 1 is provided to a wireless device 20. The radiator 122 radiates a beam radiated from the first radiator 110 as a beam ID 2, so that the beam ID 2 is provided to a wireless device 30.

Figure 18:
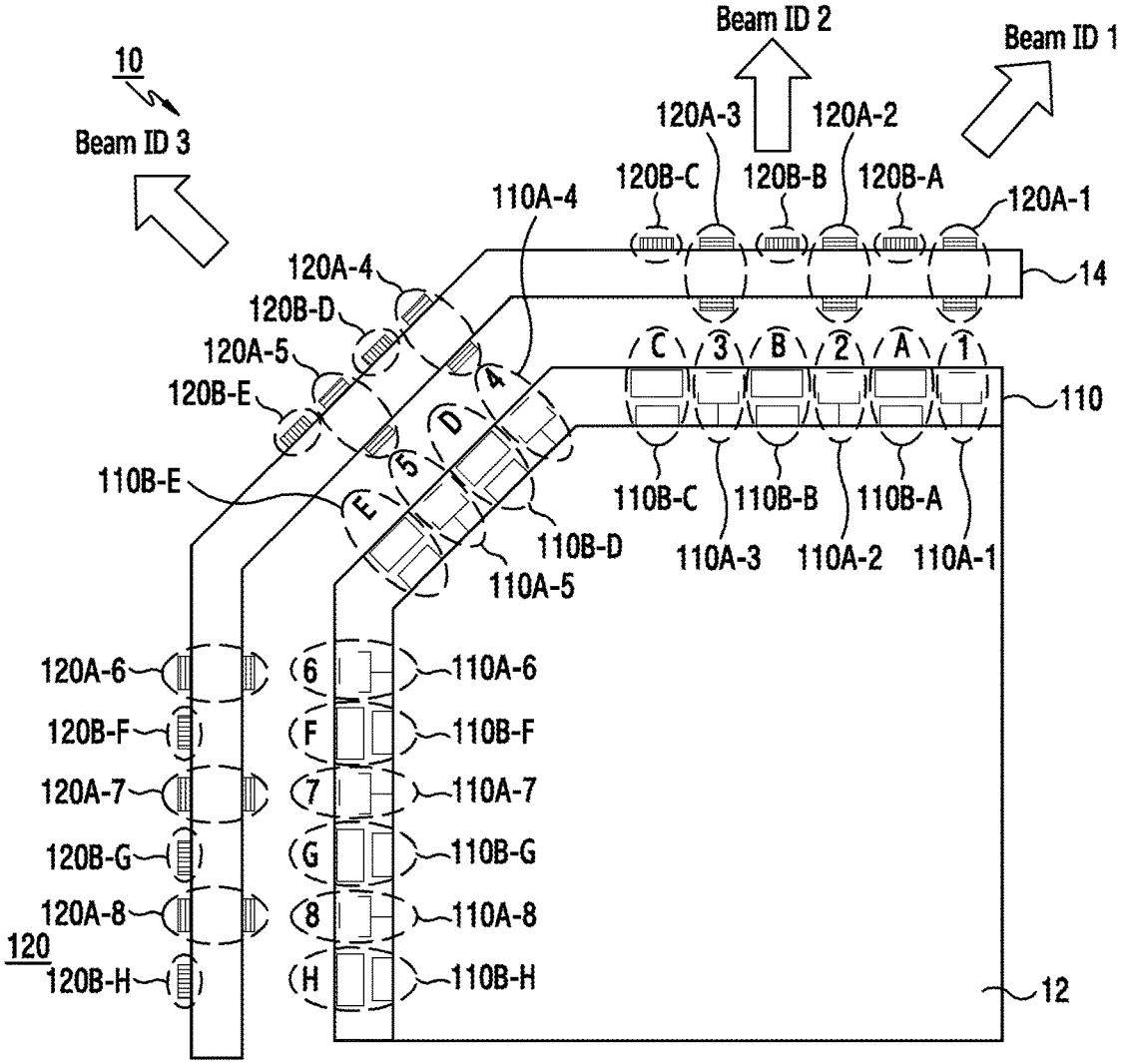

Referring to FIG. 18, a first radiator (or driver) 110 is included in a PCB 12 of a wireless device 10. For example, the first radiator 110 is disposed at an edge of the PCB 12. A second radiator (or director) 120 is included in a cover (or case) 14 of the wireless device 10. The first radiator 110 and the second radiator 120 constitute an array antenna for supporting multi-beam transmission/reception. For this, the first radiator 110 includes a plurality of antenna patterns having a structure in which a first antenna pattern 110A and a second antenna pattern 110B are repeated, and the second radiator 120 includes a plurality of parasitic patches having a structure in which a first parasitic patch 120A and a second parasitic patch 120B are repeated. The first parasitic patch 120A is installed on both of an upper portion and lower portion of the cover 14. The second parasitic patch 120B is installed on the upper portion of the cover 14. The first antenna pattern 110A and the first parasitic patch 120A are horizontal polarization (HP) elements, and the second antenna pattern 110B and the second parasitic patch 120B are vertical polarization (VP) elements.

For example, a pair of a first antenna pattern 110A-1 and a first parasitic patch 120A-1, a pair of a first antenna pattern 110A-2 and a first parasitic patch 120A-2, and a pair of a first antenna pattern 110A-3 and a first parasitic patch 120A-3 are HP antenna elements. Further, a pair of a first antenna pattern 110A-4 and a first parasitic patch 120A-4, a pair of a first antenna pattern 110A-5 and a first parasitic patch 120A-5, a pair of a first antenna pattern 110A-6 and a first parasitic patch 120A-6, a pair of a first antenna pattern 110A-7 and a first parasitic patch 120A-7, and a pair of a first antenna pattern 110A-8 and a first parasitic patch 120A-8 are HP antenna elements.

For example, a pair of a second antenna pattern 110B-A and a second parasitic patch 120B-A, a pair of a second antenna pattern 110B-B and a second parasitic patch 120B-B, and a pair of a second antenna pattern 110B-C and a second parasitic patch 120B-A are VP antenna elements. Further, a pair of a second antenna pattern 110B-D and a second parasitic patch 120B-D, a pair of a second antenna pattern 110B-E and a second parasitic patch 120B-E, a pair of a first antenna pattern 110B-F and a second parasitic patch 120B-F, a pair of a second antenna pattern 110B-G and a second parasitic patch 120B-G, and a pair of a second antenna pattern 110B-H and a first parasitic patch 120B-H are VP antenna elements.

The plurality of antenna patterns and the plurality of parasitic patches may operate as an array antenna as shown in Table 2 below.

TABLE 2

| Beam | Antenna |
|---|---|
| Beam ID 1 | VP: A~D (4EA)<br>HP: 1~4 (4EA) |
| Beam ID 2 | VP: A~D (4EA)<br>HP: 1~4 (4EA) |
| Beam ID 3 | VP: A~H (8EA)<br>HP: 1~8 (8EA) |

In an embodiment of the present disclosure, antenna elements A to D are used for a vertical polarization of a beam ID 1, and antenna elements 1 to 4 are used for a horizontal polarization of the beam ID 1. In an embodiment of the present disclosure, the antenna elements A to D are used for a vertical polarization of a beam ID 2, and antenna elements 1 to 4 are used for a horizontal polarization of the beam ID 2. In an embodiment of the present disclosure, the antenna elements A to H are used for a vertical polarization of a beam ID 3, and antenna elements 1 to 8 are used for a horizontal polarization of the beam ID 3.

Figure 19:
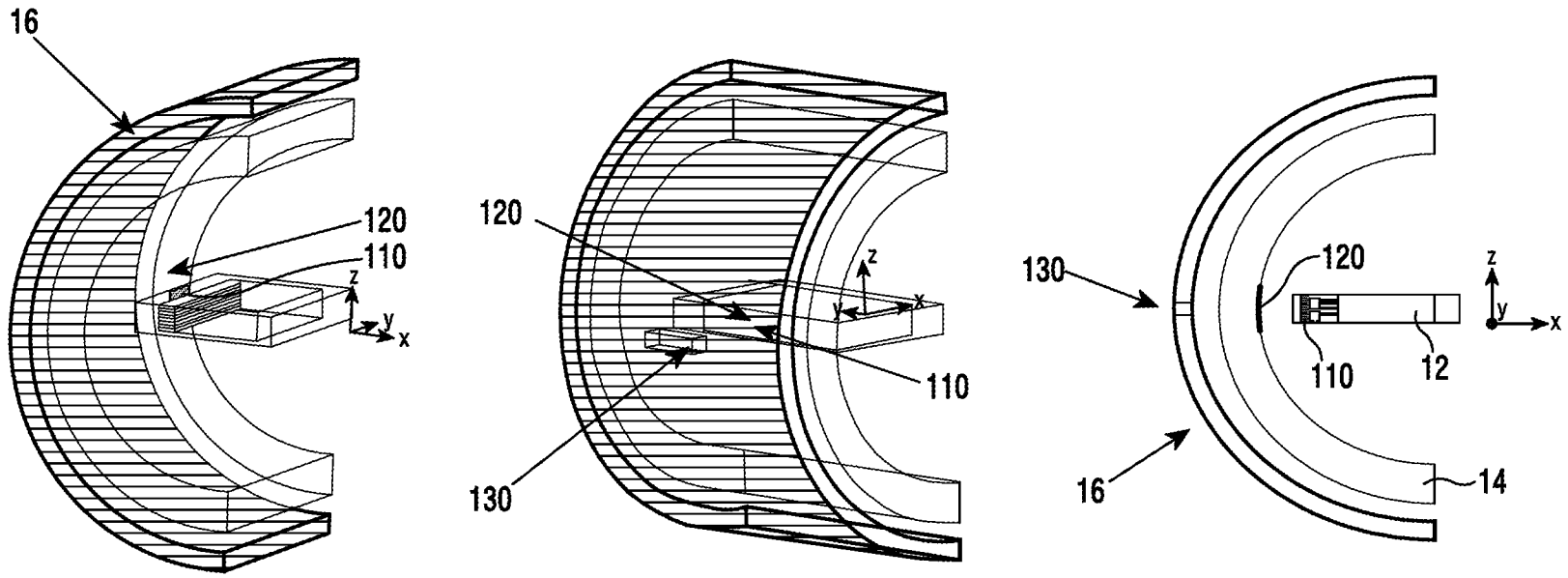

Referring to FIG. 19, a first radiator 110 is included in a PCB 12 of a wireless device 10. A second radiator 120 is included in a cover (or case) 14 of the wireless device 10. The second radiator 120 faces the first radiator 110 and is installed by being separate from the first radiator 110 and radiates a radio signal radiated by the first radiator 110. That is, the second radiator 120 is a non-contact type radiator which is not in contact with the first radiator 110. The cover 14 may include at least one material among PCB, silicon, LTCC, and LCP.

A metal case 16 is located outside the cover 14, and surrounds the cover 14. The metal case 16 includes an opening 130. The opening 130 is located in a position corresponding to the second radiator 120, and provides a delivery path of a radio signal that is radiated by the second radiator 120.

In an embodiment of the present disclosure, the first radiator 110 includes a feeding unit, a ground plane, and an antenna pattern. The antenna pattern radiates a radio signal from the transceiver 200. The antenna pattern may include an array antenna pattern. In an embodiment of the present disclosure, the antenna pattern may include a plurality of capacitively coupled patterns. In an embodiment of the present disclosure, the antenna pattern may include patterns each having a different polarization characteristic. For example, the antenna pattern may include at least one of an IFA pattern, a dipole antenna pattern, a loop antenna pattern, and a helical antenna pattern.

In an embodiment of the present disclosure, the first radiator 110 may include a linear radiator.

In an embodiment of the present disclosure, the second radiator 120 may include at least one of the linear radiator and a non-linear radiator. The second radiator 120 may include one or more conductive parasitic patches located at predetermined positions of the cover 14. The location of the conductive parasitic patch may be determined on the basis of a separation distance d between the first radiator 110 and the second radiator 120, a radius of curvature Ra of the second radiator 120, and a wavelength $\lambda$ corresponding to a frequency f of a radio signal. For example, the second radiator 120 may be located in a predetermined separation distance (e.g., $0.2\lambda \sim 1\lambda$) while being parallel to a surface of the first radiator 110.

Figure 20:
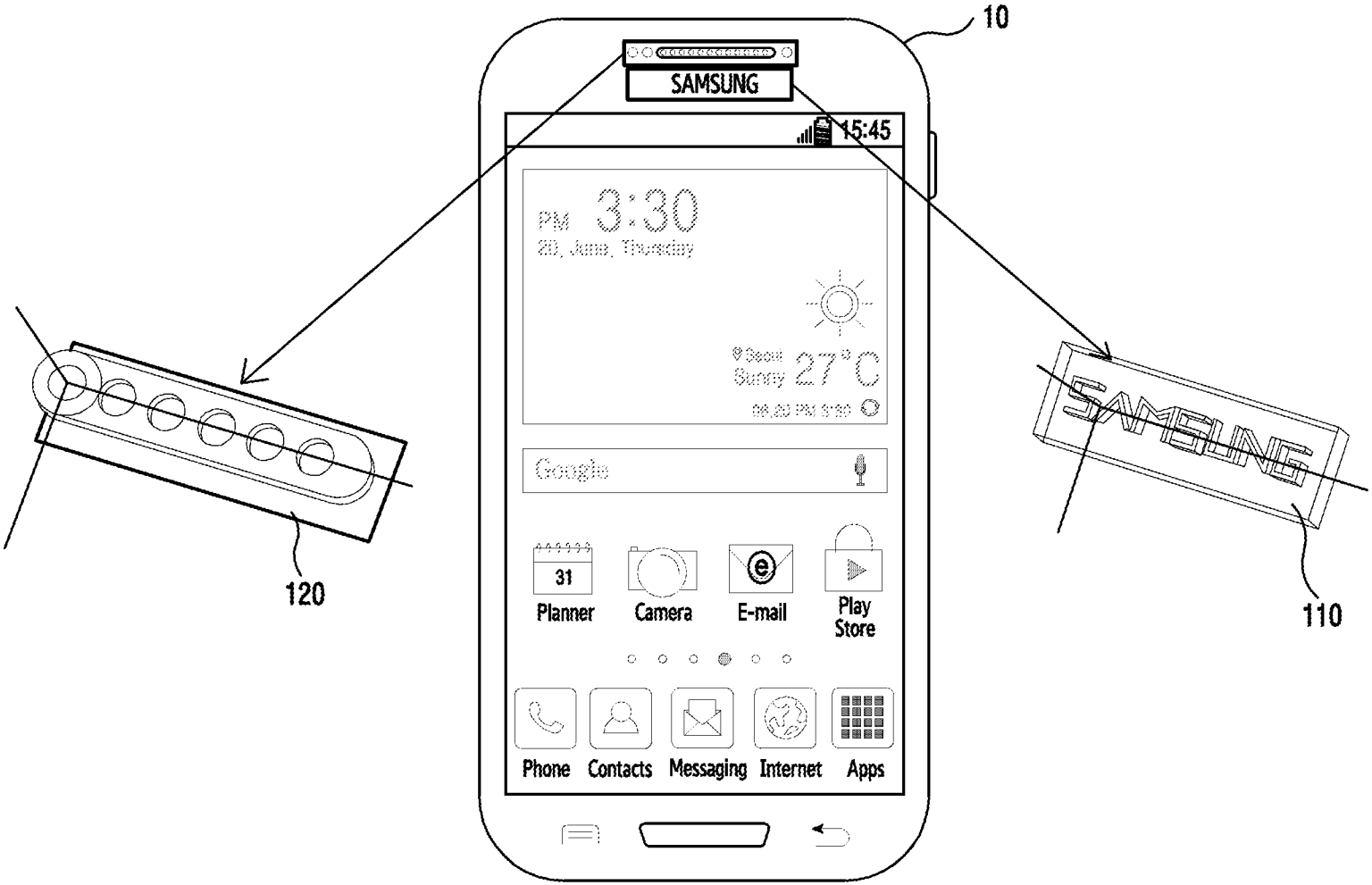

Referring to FIG. 20, a speaker installed to an upper portion of a wireless device 10 functions as a second radiator 120, and a logo "SAMSUNG" functions as a first radiator 110. In an embodiment of the present disclosure, a part of the logo "SAMSUNG" may function as the first radiator 110. Since the elements of the wireless device 10 according to the related art are used as a part of an antenna structure as described above, space in the wireless device can be increased, and signal loss can be decreased.

Figure 21:
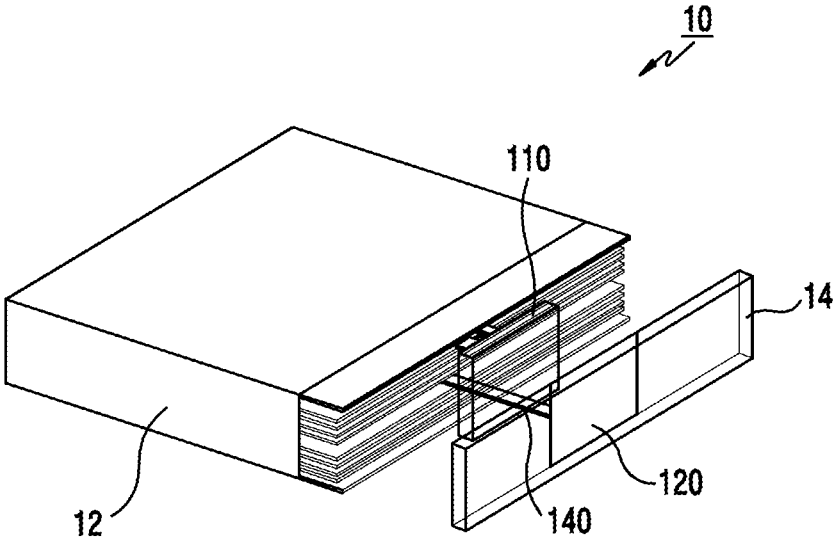

Referring to FIG. 21, a first radiator 110 is included in a PCB in a wireless device 10. A second radiator 120 is included in a cover (or case) 14 of the wireless device 10. The second radiator 120 facing the first radiator 110 is installed by being separated from the first radiator 110 and radiates a radio signal radiated by the first radiator 110. A connector 140 connects the first radiator 110 and the second radiator 120. The connector 140 delivers a current and does not affect a resonant frequency. With this antenna structure, a log periodic antenna is configured.

As described above, various embodiments of the present disclosure propose an antenna having a structure in which an antenna based on a cover (or case) of a wireless device and an antenna based on a PCB included in a main body are combined. The various embodiments of the present disclosure form a part of a radiator on the cover of the wireless device and thus increases a space in the wireless device. In addition, the various embodiments of the present disclosure form a part of a radiator to the cover of the wireless device and thus increase a signal throughput in comparison with the antenna having a radiator formed only on the PCB of the main body, according to the related art.

While the present disclosure has been shown and described with reference to various embodiments thereof, it will be understood by those skilled in the art that various changes in form and details may be made therein without departing from the spirit and scope of the present disclosure as defined by the appended claims and their equivalents.

What is claimed is:

1. An antenna of a wireless device, the antenna comprising:

a first radiator to radiate a radio signal;

a second radiator disposed on a cover of the wireless device to radiate the radio signal based on a first beam; and a third radiator disposed on the cover of the wireless device to radiate the radio signal based on a second beam that is different from the first beam, wherein the second radiator is disposed on a first position spaced apart from and facing the first radiator, wherein the third radiator is disposed on a second position spaced apart from and facing the first radiator, wherein the second radiator comprises a curved radiator, wherein the third radiator comprises a curved radiator, wherein a direction of the first beam is associated with the first position of the second radiator on the cover, wherein a direction of the second beam is associated with the second position of the third radiator on the cover, wherein the first radiator includes a plurality of antenna patterns, wherein the second radiator includes a plurality of first parasitic patches for a first polarization of the first beam and a plurality of second parasitic patches for a second polarization of the first beam, and wherein the third radiator includes a plurality of third parasitic patches for a first polarization of the second beam and a plurality of fourth parasitic patches for a second polarization of the second beam.

2. The antenna of claim 1, wherein the first radiator comprises:

a feeding unit, a ground plane, and an antenna pattern, wherein the antenna pattern comprises an array antenna pattern, and wherein the first radiator comprises a linear radiator.

3. The antenna of claim 1, wherein the first radiator is disposed in a main body of the wireless device, or wherein the first radiator is disposed on a printed circuit board (PCB) in the main body of the wireless device.

4. The antenna of claim 1, wherein a ratio Zp/λ of a length Zp of the second radiator to a wavelength λ corresponding to a frequency of the radio signal is in a range of 0.1 to 0.3.

5. The antenna of claim 1, wherein the cover comprises at least one material among a printed circuit board (PCB), silicon, low temperature co-fired ceramic (LTCC), or liquid crystal polymer (LCP).

6. The antenna of claim 1, wherein the cover of the wireless device is a curved cover corresponding to the curved radiator, and wherein a radius of curvature of the cover is same as a radius of curvature of the second radiator or a radius of curvature of the third radiator.

7. The antenna of claim 1, wherein a ratio d/λ of a separation distance d between the first radiator and the second radiator to a wavelength λ corresponding to the frequency of the radio signal is in a range of 0.02 to 0.4.

8. A wireless device comprising:

a main body comprising a first radiator to radiate a radio signal; and a cover comprising:

a second radiator disposed on a cover of the wireless device to radiate the radio signal based on a first beam, and a third radiator disposed on the cover of the wireless device to radiate the radio signal based on a second beam that is different from the first beam, wherein the second radiator disposed on a first position that faces and is spaced apart from the first radiator, wherein the third radiator disposed on a second position that faces and is spaced apart from the first radiator, wherein the second radiator comprises a curved radiator, wherein the third radiator comprises a curved radiator, wherein a direction of the first beam is associated with the first position of the second radiator on the cover, wherein a direction of the second beam is associated with the second position of the third radiator on the cover, wherein the first radiator includes a plurality of antenna patterns, wherein the second radiator includes a plurality of first parasitic patches for a first polarization of the first beam and a plurality of second parasitic patches for a second polarization of the first beam, and wherein the third radiator includes a plurality of third parasitic patches for a first polarization of the second beam and a plurality of fourth parasitic patches for a second polarization of the second beam.

9. The wireless device of claim 8, wherein the first radiator comprises:

a feeding unit, a ground plane, and an antenna pattern, wherein the antenna pattern comprises an array antenna pattern, and wherein the first radiator comprises a linear radiator.

10. The wireless device of claim 8, wherein a ratio Zp/λ of a length Zp of the second radiator to a wavelength λ corresponding to a frequency of the radio signal is in a range of 0.1 to 0.3.

11. The wireless device of claim 8, wherein the cover comprises at least one material among a printed circuit board (PCB), silicon, low temperature co-fired ceramic (LTCC), or liquid crystal polymer (LCP).

12. The wireless device of claim 8, further comprising:

a metal case surrounding the cover, wherein the metal case comprises an opening, located in a position corresponding to a conductive parasitic patch, for providing a delivery path of the radio signal radiated by the second radiator.

13. The wireless device of claim 8, wherein the cover of the wireless device is a curved cover corresponding to the curved radiator, and wherein a radius of curvature of the cover is same as a radius of curvature of the second radiator or a radius of curvature of the third radiator.

14. The wireless device of claim 8, wherein a ratio d/λ of a separation distance d between the first radiator and the second radiator to a wavelength λ corresponding to the frequency of the radio signal is in a range of 0.02 to 0.4.

* * * * *